United States Patent [19]

Cardell

[11] 4,437,617

[45] Mar. 20, 1984

[54] WINDING APPARATUS FOR FILAMENTARY MATERIAL HAVING MEANS FOR WINDING A TRAILING END OF THE FILAMENTARY MATERIAL IN CLOSE ORDER UPON A PACKAGE

[75] Inventor: Max L. Cardell, Shelby, N.C.

[73] Assignee: Fiber Industries, Inc., Charlotte, N.C.

[21] Appl. No.: 431,911

[22] Filed: Sep. 30, 1982

Related U.S. Application Data

[63] Continuation-in-part of Ser. No. 258,309, Apr. 28, 1981, abandoned.

[51] Int. Cl.[3] ..... B65H 54/02; B65H 54/22

[52] U.S. Cl. ..... 242/18 EW; 226/97; 242/18 DD; 242/18 PW; 242/35.5 A

[58] Field of Search ..... 242/18 EW, 18 PW, 18 DD, 242/18 R, 43 R, 43.2, 35.5 A

[56] References Cited

U.S. PATENT DOCUMENTS

| | | | |
|---|---|---|---|
| 4,023,741 | 5/1977 | Schar | 242/18 R |
| 4,052,017 | 10/1977 | Schar | 242/35.5 A |
| 4,108,388 | 8/1978 | Schar | 242/18 DD |
| 4,138,072 | 2/1979 | Aoyama et al. | 242/18 EW X |
| 4,384,689 | 5/1983 | Bloomfield et al. | 242/18 EW X |

FOREIGN PATENT DOCUMENTS

| | | |
|---|---|---|
| 296203 | 1/1917 | Fed. Rep. of Germany . |
| 2312446 | 10/1981 | France . |

*Primary Examiner*—Stanley N. Gilreath
*Attorney, Agent, or Firm*—Herbert M. Adrian, Jr.

[57] ABSTRACT

Filamentary material is wound upon tubes mounted upon a winder. A traversing guide traverses the filamentary material along the package axis to produce a helical winding thereof. A control mechanism engages the filamentary material prior to completion of a winding sequence to cause the trailing end of the filamentary material to be wound for a plurality of turns in non-helical, close-order relationship on the package to resist subsequent unraveling of the filamentary material. The control mechanism comprises a movable arm which includes a contact edge oriented generally parallel to a plane defined by the traversing movement of the filamentary material. The arm is mounted for movement toward and away from such plane to contact the filamentary material upstream of the traversing guide and displace same out of the latter. The contact edge includes a stop for constraining the filamentary material for winding in a non-helical, close-order relationship onto the package.

12 Claims, 47 Drawing Figures

322A
312
160
160
334
336
346
326
148
41
334
50
58
306
142
140
318A
318
364
308
316
110
368
344
320
322A
312
322
316
312
314
342
174
312
186
270
316
310
305
307A
P1
P2 P3
P4
307
354
280
288
TRANSFER
TAIL LATCH
CYLINDER
354
AIR
SUPPLY

WINDING APPARATUS FOR FILAMENTARY MATERIAL HAVING MEANS FOR WINDING A TRAILING END OF THE FILAMENTARY MATERIAL IN CLOSE ORDER UPON A PACKAGE

RELATED APPLICATION

This is a Continuation-in-Part of my copending U.S. Pat. application Ser. No. 6,258,309, filed Apr. 28, 1981, and entitled "Apparatus for Cutting, Aspirating and Rethreading a Traveling Filamentary Yarn", now abandoned.

BACKGROUND AND OBJECTS OF THE INVENTION

The present invention relates generally to the high speed winding of filamentary material onto bobbins or spools to form packages of filamentary material. More particularly, it relates to the handling of man-made filament yarn during the final stages of winding a full package.

The manufacture of man-made or synthetic filament yarns is typically achieved by extruding a molten polymer, such as polyester, polyamide, etc., through hole(s) in a spinneret and then cooling the filament(s) thus formed. Thereafter, the filaments may be gathered together to form a multi-filament yarn and, possibly after further treatment, are wound onto a tube so that a yarn package is formed.

Winding of the yarn is performed mechanically by winders which rotate one or more tubes to wind-up the yarn while traversing the yarn along the tube axis to achieve a uniform thickness of yarn being wound.

A doffing/donning operation (i.e., replacement of the yarn packages with empty tubes on the winder) is often performed manually by an operator who (i) severs the yarn, (ii) stops the rotary drive to the packages, (iii) replaces the packages with empty tubes, (iv) re-establishes the rotary drive between the winder drive head and the tubes, and (v) rethreads the yarn onto the empty tubes. Severing of the filamentary yarn is typically performed with scissors while the inlet of a suction or aspirator gun is held against the yarn at a location above the point of severing. Once the yarn is severed, the trailing end of the yarn is wound onto the yarn package, while the newly formed leading end of the yarn is sucked into the aspirator and fed to a waste collector. The suction gun is then placed onto a holder while the yarn packages are being replaced by empty tubes. When the empty tubes attain full speed, the operator manipulates the suction gun to attach the yarn to the rotating tubes so that this winding operation may begin.

In order to economize such winding operations, it has heretofore been proposed to mechanize the doffing and donning operations to a certain extent by providing a mechanism which automatically severs, aspirates and rethreads the yarn. Exemplary of proposed mechanisms of that type are the disclosures in U.S. Pat. No. 4,023,741 issued to Schar on May 17, 1977; U.S. Pat. No. 4,052,017 issued to Schar on Oct. 4, 1977; and U.S. Pat. No. 4,108,388 issued to Schar on Aug. 22, 1978.

At the end of a winding sequence and after the yarn has been cut, the package spindle is braked to a stop. If the yarn trailing end is not tightly wound on the package it may unravel to some extent as the package decelerates to a stop. The tendency for the yarn to unravel may be heightened in cases where the package is surface-driven by a drive roll on a winder head. That is, as the winder head lifts from the filled package, the yarn trailing end is subjected to the turbulent wind created by the still-rotating drive roll and/or grooved guide roll. Such an unwound end can pose problems as it whips about against the decelerating package because it may tend to impact against and damage the exposed windings of yarn on the package.

It has been heretofore proposed in U.S. Pat. No. 4,384,689 to alleviate this problem by displacing the yarn trailing end from the traverse guide and grooved roll of the winder just prior to termination of the winding sequence and transferring such end to a winding guide which holds this yarn trailing end against traversing movement along the axis of the package. As a result, the yarn trailing end is wound in close order upon the package whereby subsequent unraveling of the trailing end is effectively resisted. Transferal of the yarn can be achieved by a deflector guide which is moved parallel to the spindle axis, or the winding guide itself can be so moved. The grooved roll is provided with a circumferential (non-helical) groove which aids in holding the yarn against traversing movement.

The problem of loose trailing ends has also been dealt with in German Patent No. 296,203 and French Patent No. 2,312,446. In the latter it has been proposed to position a movable bar intermediate the traverse guide and the package. The bar is moved into engagement with the yarn at the end of the winding sequence in a direction perpendicular to the spindle axis. The bar has a notch which captures the yarn and resists further helical winding of the yarn on the packages. As a result, the yarn is wound in relatively close order on the package to resist subsequent unraveling. Thus, the yarn is permitted to be oscillated by means of the traverse guide, e.g., a reciprocable slot or a grooved roll, while being restrained against traversing movement by a stationary notch immediately downstream of the traverse guide. Under those conditions, however, there may be a tendency for the yarn to be adversely affected. That is, at the extreme ends of its traversing or oscillatory travel, the yarn extends at a relative sharp angle around the traverse guide as it heads toward the stationary notch. Travel of the yarn through such an angle can result in a severe stressing of the yarn, imparting so-called "tension spikes" to the yarn which adversely affects the die absorbing characteristics of the yarn. Moreover, it is possible that the continuous traversing movement of the yarn upstream of the notch may cause the yarn to be prematurely dislodged from the notch.

It is, therefore, an object of the present invention to minimize or obviate problems of the type described above.

Another object is to wind a trailing yarn end in close order onto a package to prevent subsequent unraveling.

A further object is to provide such a close-order winding without imposing tension spikes in the yarn.

An additional object is to provide such close-order winding while resisting premature dislodgement of the yarn from a stationary yarn holder.

A further object is to provide a simplified, compact apparatus for ejecting a yarn from its traverse guide and holding the yarn for close-order winding on a passage.

SUMMARY OF THE INVENTION

These objects are achieved by the present invention which relates to a winder for winding packages of filamentary material. The winder includes a mount for rotating a package about a longitudinal axis to wind-up filamentary material which is fed thereto. A traversing guide traverses the filamentary material along the package axis to produce a helical winding of the filamentary material. A control mechanism engages the filamentary material prior to completion of a winding sequence to cause the trailing end of the filamentary material to be wound for a plurality of turns in non-helical, close-order relationship on the package to resist subsequent unraveling of the filamentary material. The control mechanism comprises a movable arm which includes a contact edge oriented generally parallel to a plane defined by the traversing movement of the filamentary material. The arm is mounted for movement toward and away from such plane to contact the filamentary material and displace same out of the traversing guide. The contact edge includes a stop for constraining the filamentary material for winding in a non-helical, close-order relationship onto the package.

Preferably, the movable arm contacts the filamentary material upstream of the traverse guide and comprises a generally horizontal plate which is movable horizontally toward and away from the plane of oscillation of the filamentary material.

The contact edge of the plate preferably includes a notch which constitutes a stop for engaging and constraining the yarn against traversing movement.

THE DRAWINGS

The objects and advantages of the present invention will become apparent from the following detailed description of a preferred embodiment thereof, in connection with the accompanying drawings, in which like numerals designate like elements, and in which.

Figure 1:
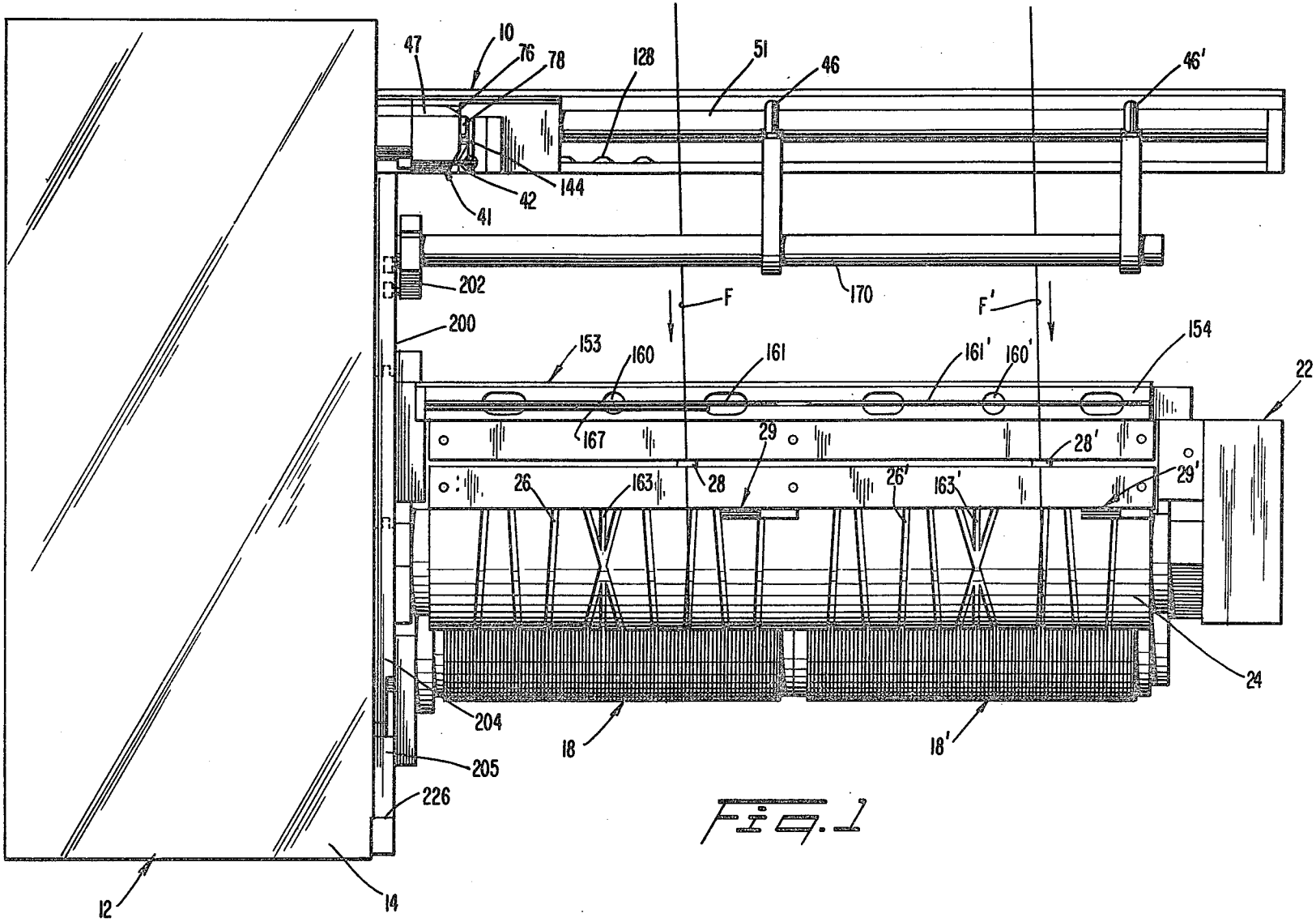
FIG. 1 is a front elevational view of a winder and aspirator mechanism according to the present invention, as the winding of two yarns proceeds.
Figure 4:
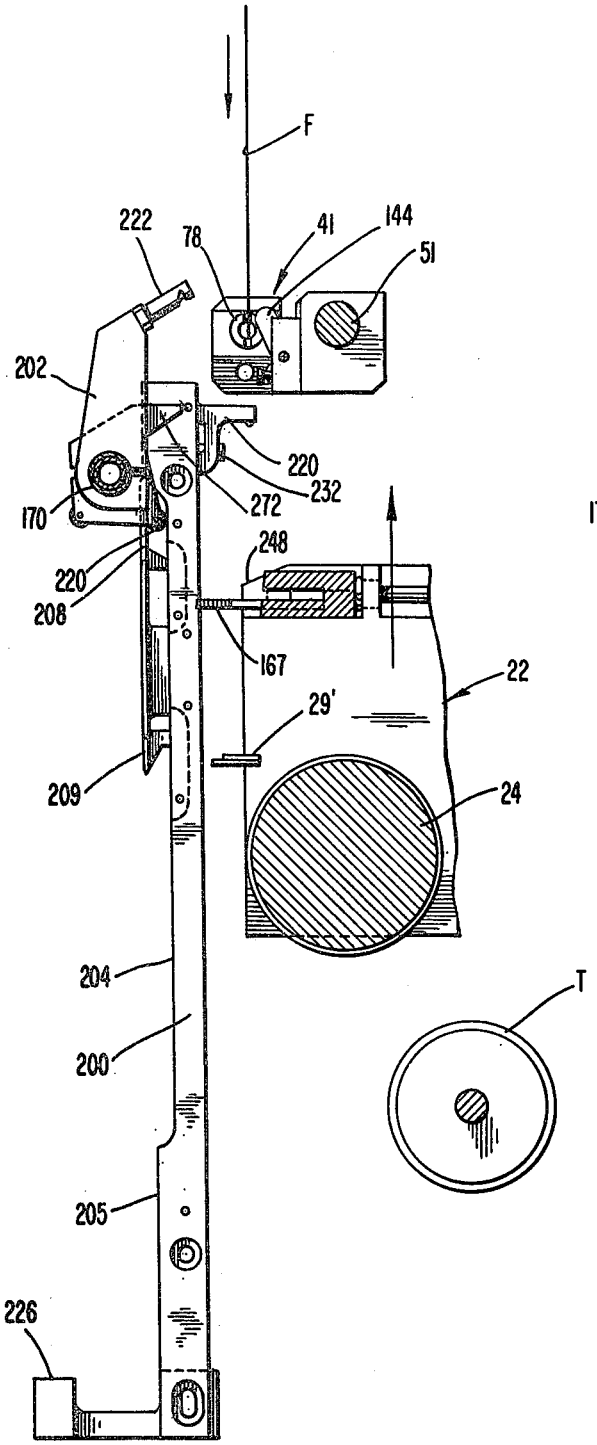
FIG. 4 is a cross-sectional view through the winder in the winding mode depicted in FIG. 1.
Figure 6:
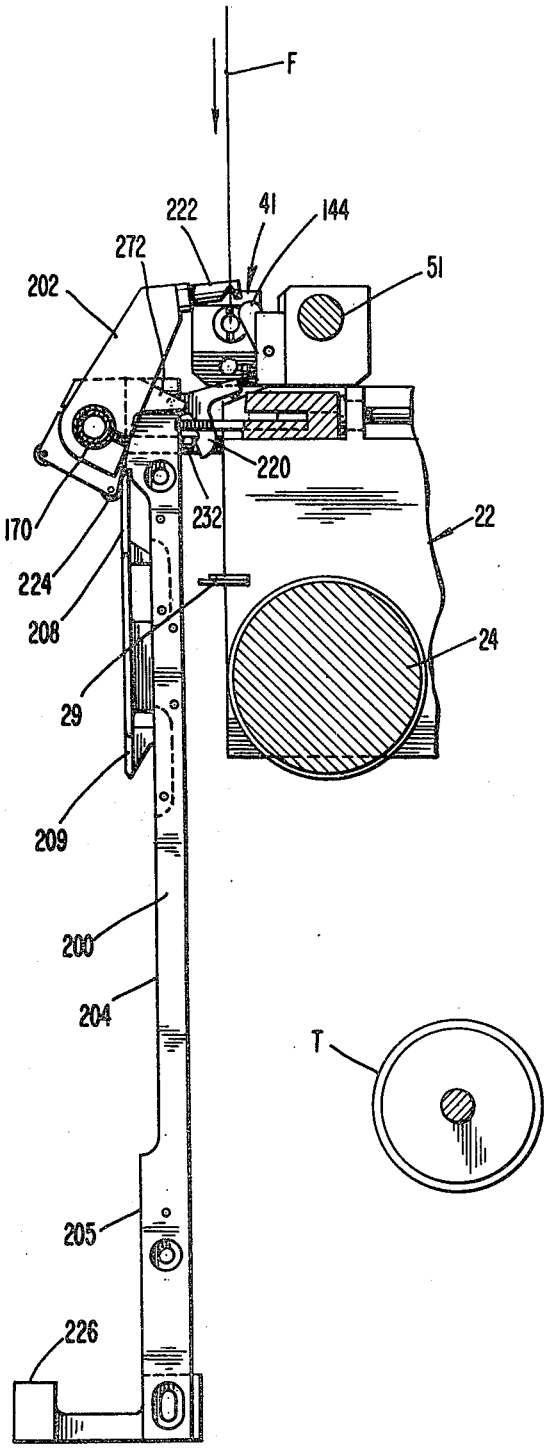
FIG. 6 is a view similar to FIG. 5 as the transport arms begin a downward stroke, with the yarns captured therein.
Figure 7:
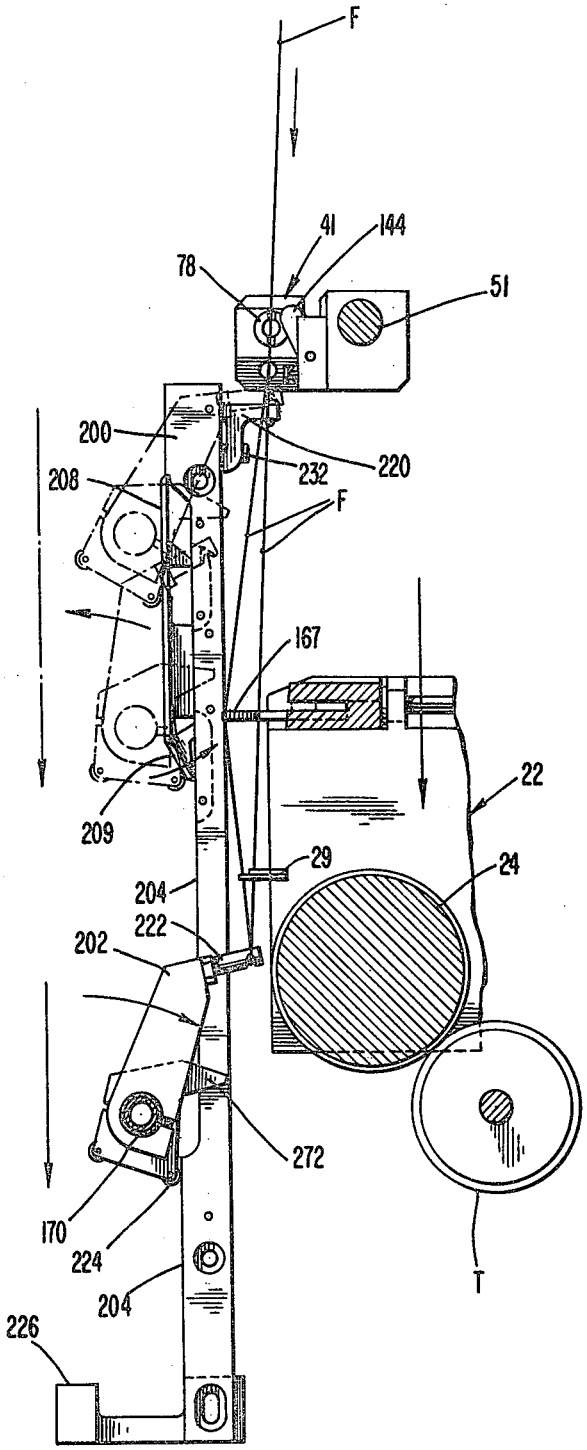
FIG. 7 is a view similar to FIG. 6 depicting various stages of the downward movement of the transport arms, the solid line position depicting the mode in which the transfer arms thread the yarns into the tail maker mechanism according to the present invention.
Figure 8:
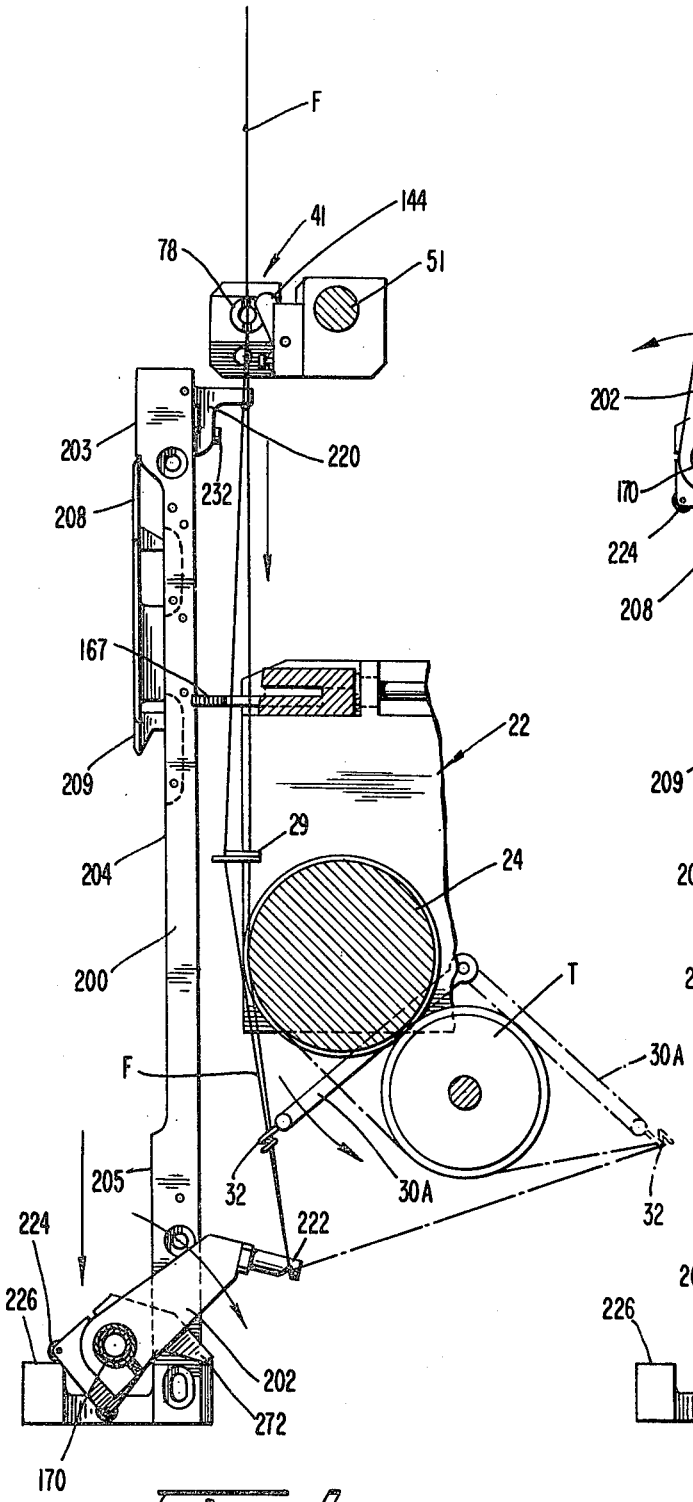
FIG. 8 is a view similar to FIG. 7 after the transport arms have reached their lowermost position and have threaded the yarns into the throw-on mechanism of the winder.
Figure 9:
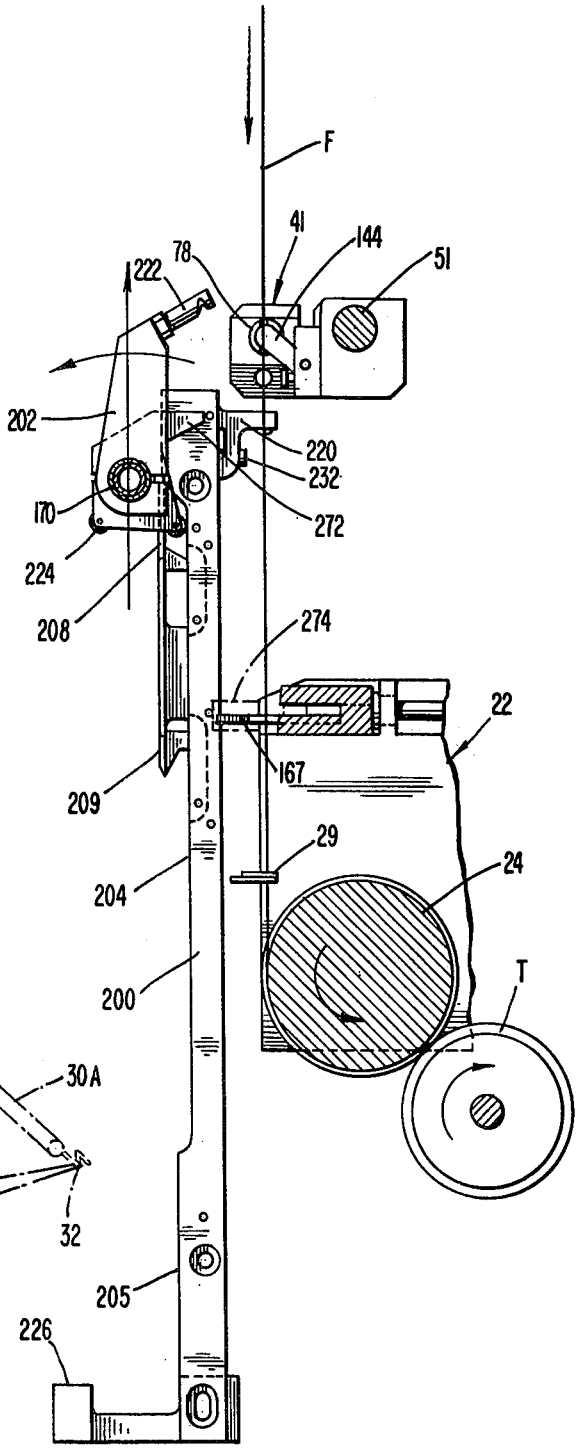
FIG. 9 is a view similar to FIG. 8, depicting the transfer arms in an upper rest position awaiting the next sequential aspirating step.
Figure 10:
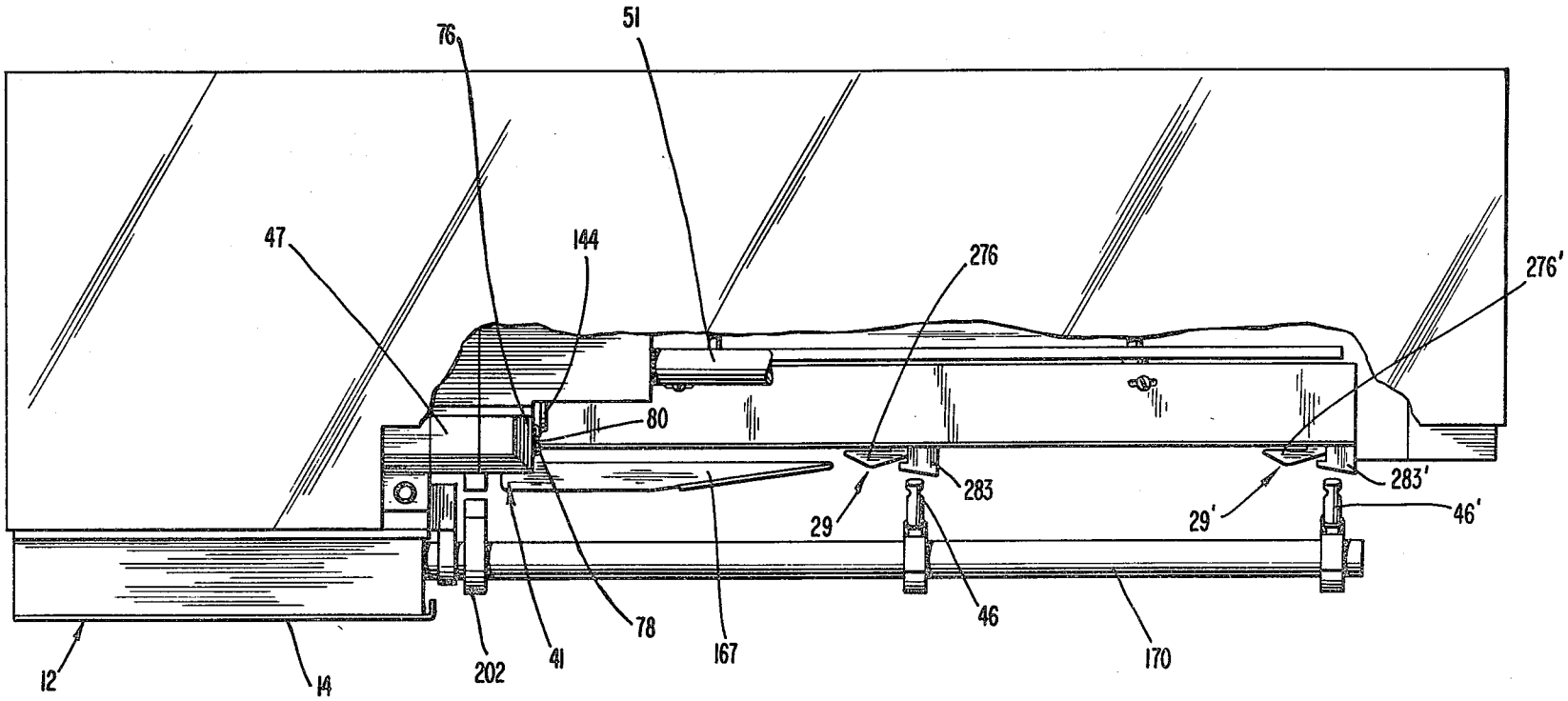
FIG. 10 is a plan view of the apparatus depicted in FIG. 1, with a portion of an upper housing wall broken away to depict the cutter head and transfer arms in their rest or parked positions.
Figure 11:
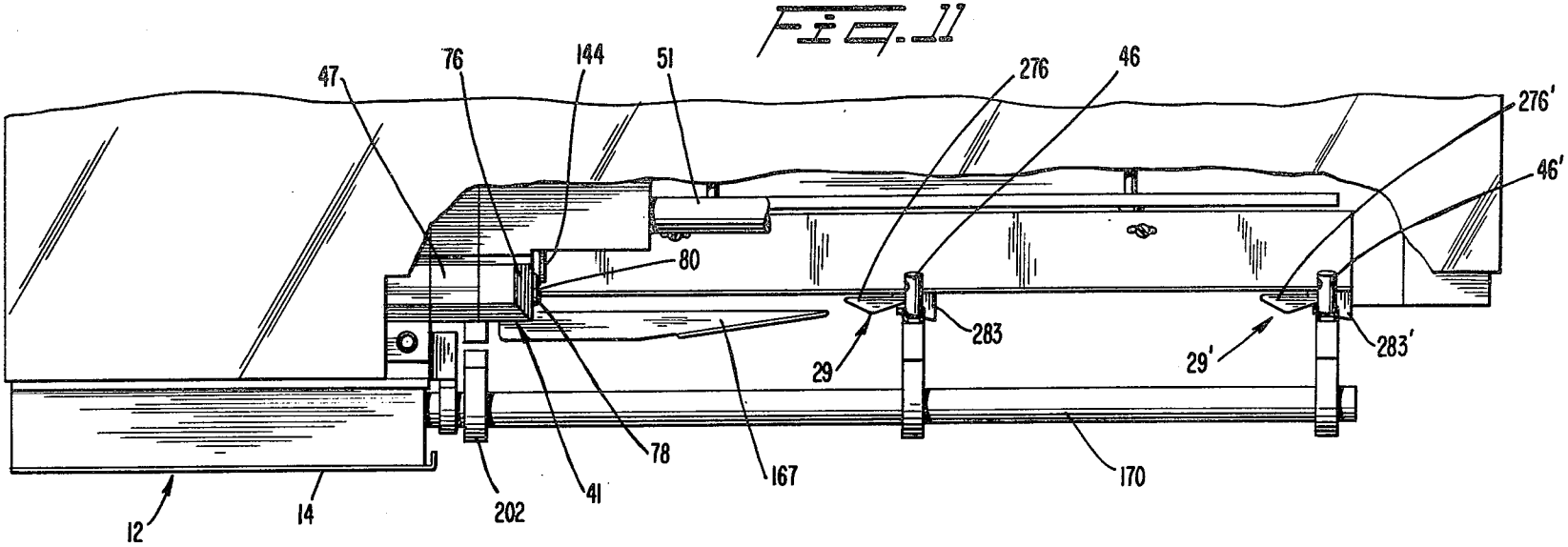
Figure 12:
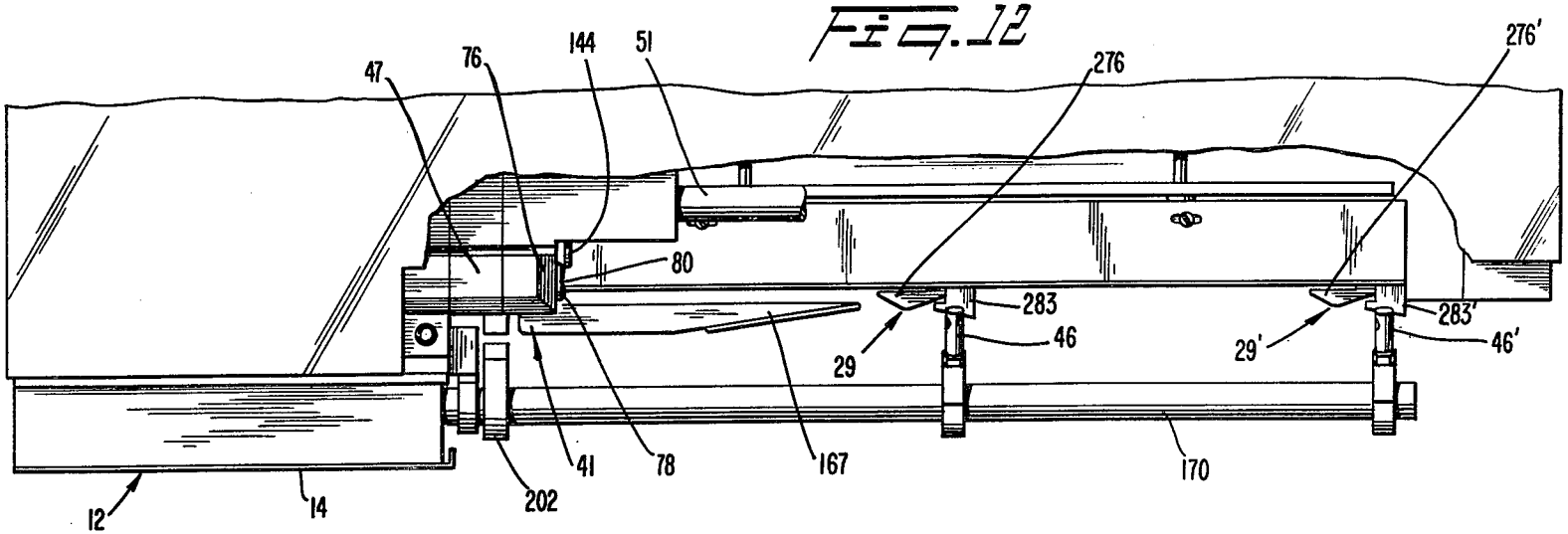
Figure 13:
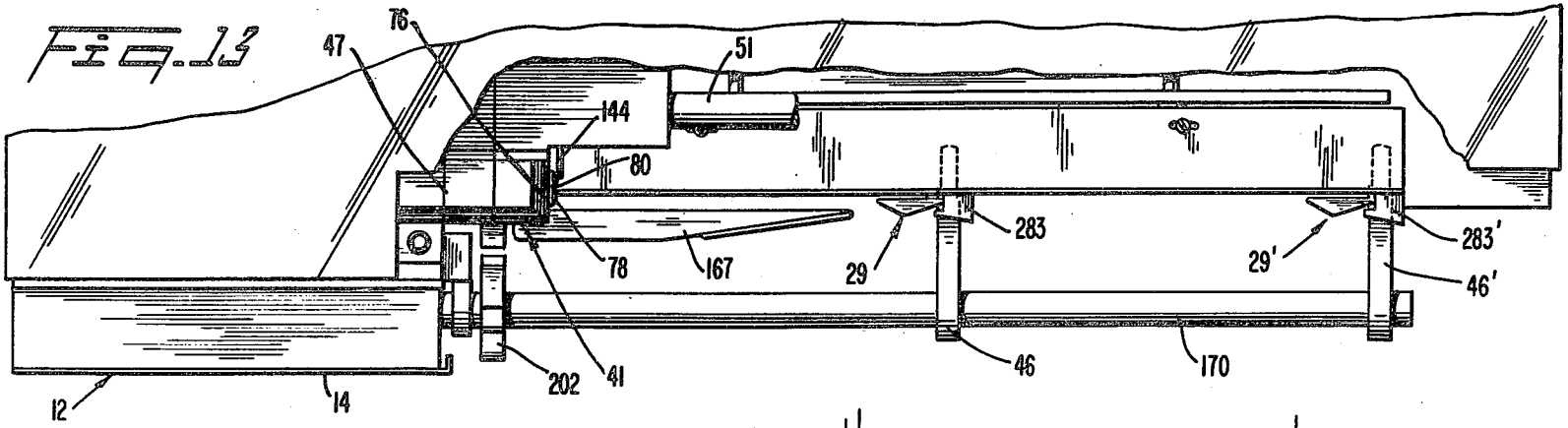
Figure 14:
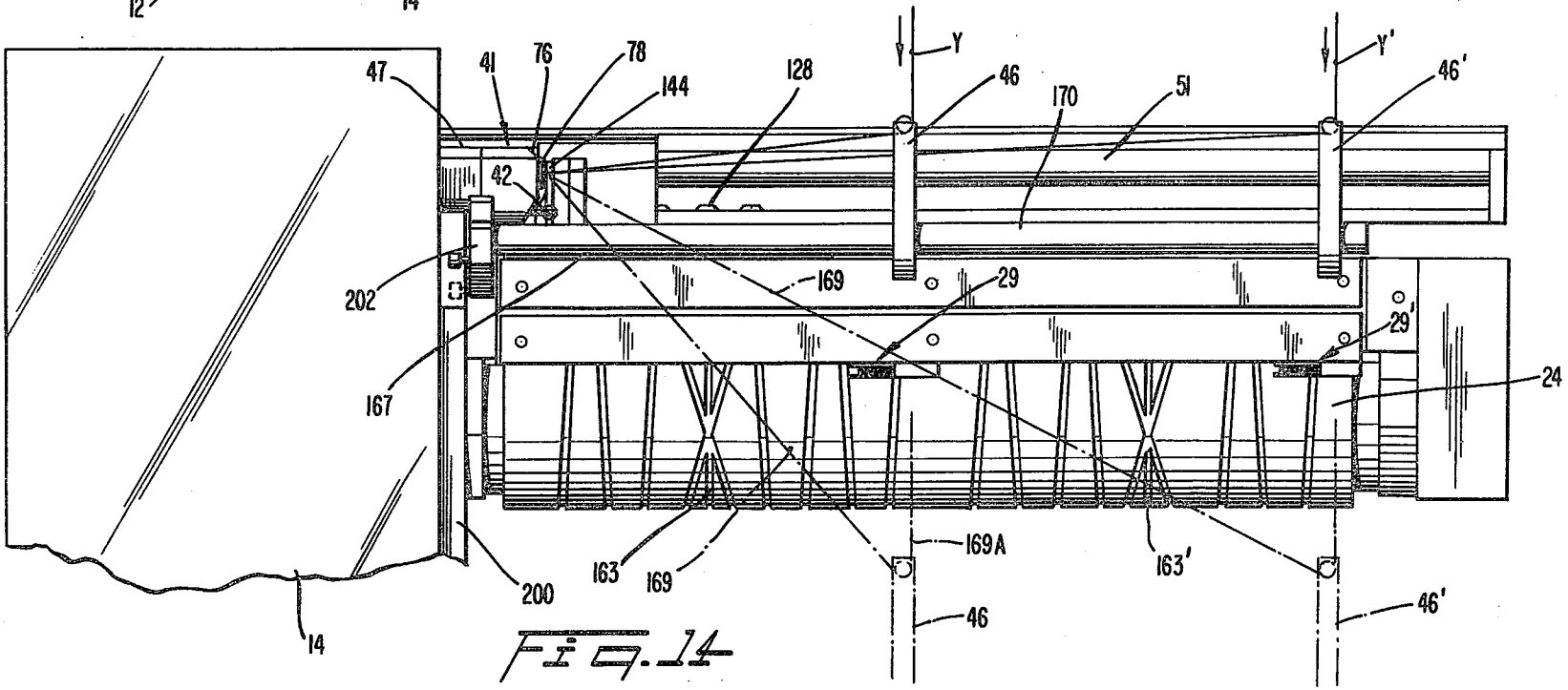
Figure 15:
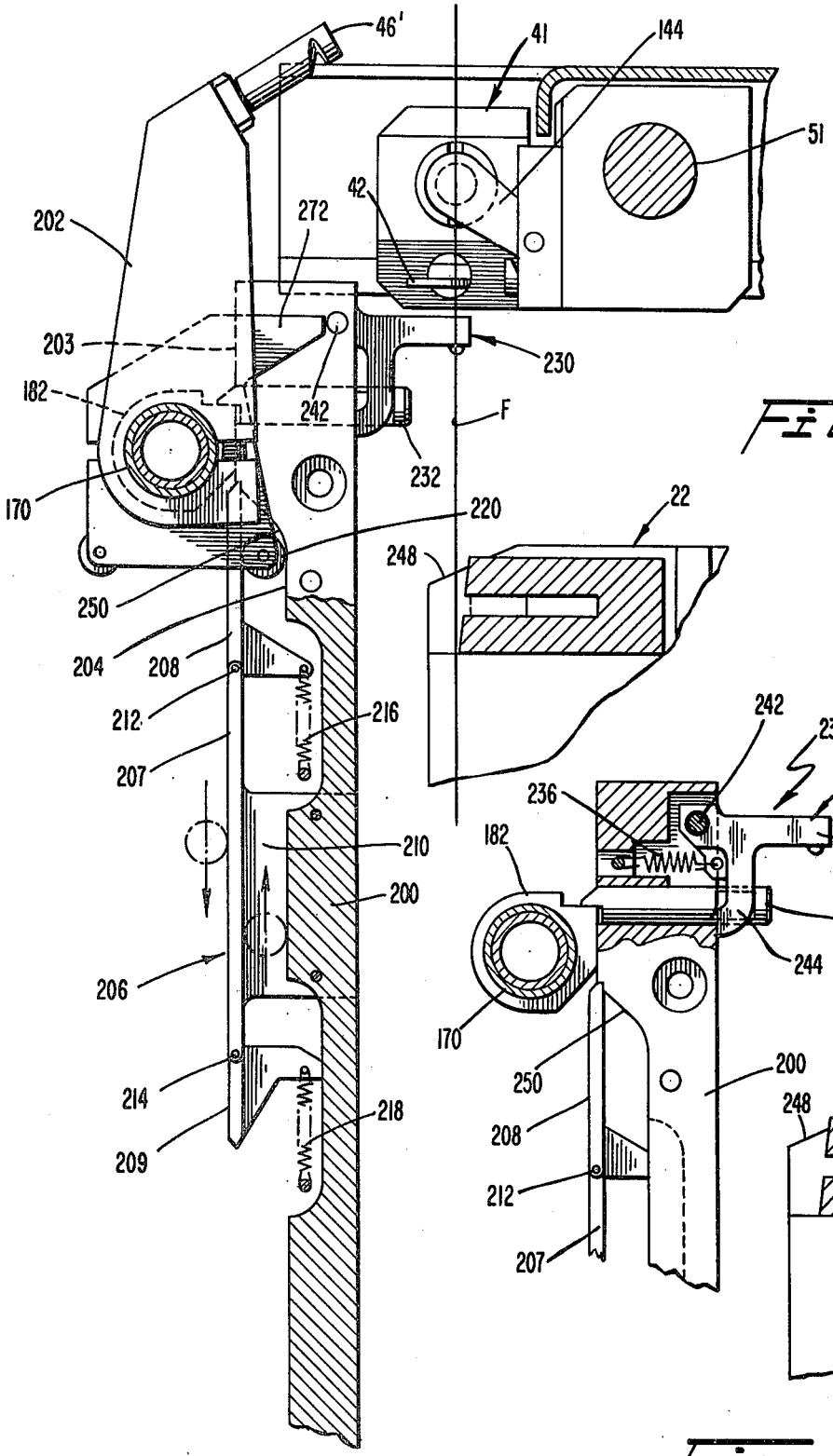
Figure 16:
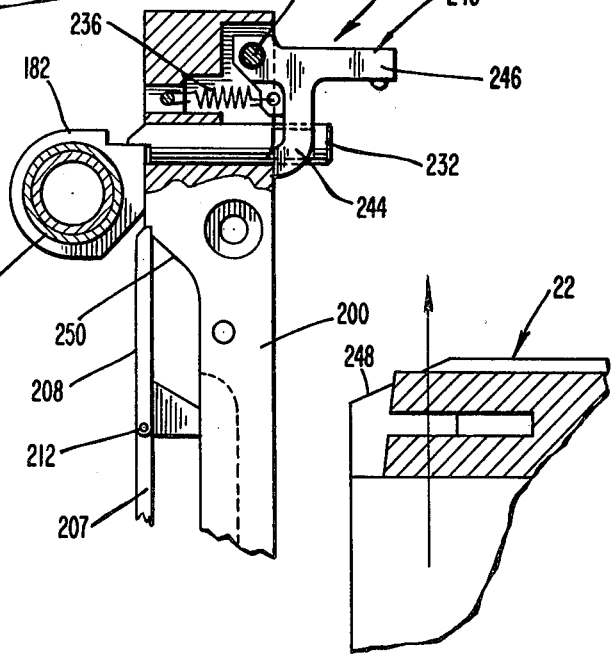
Figure 17:
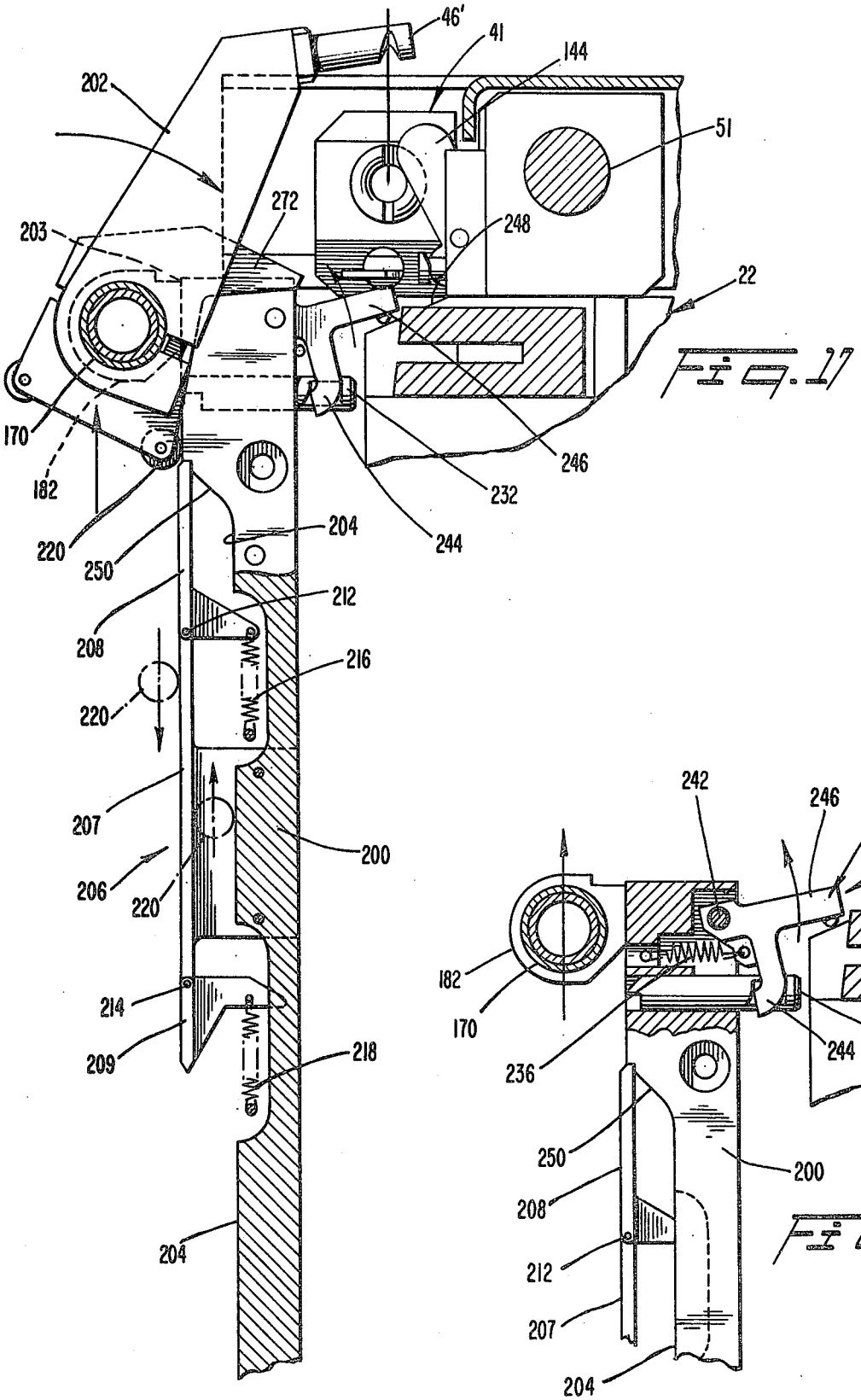
Figure 18:
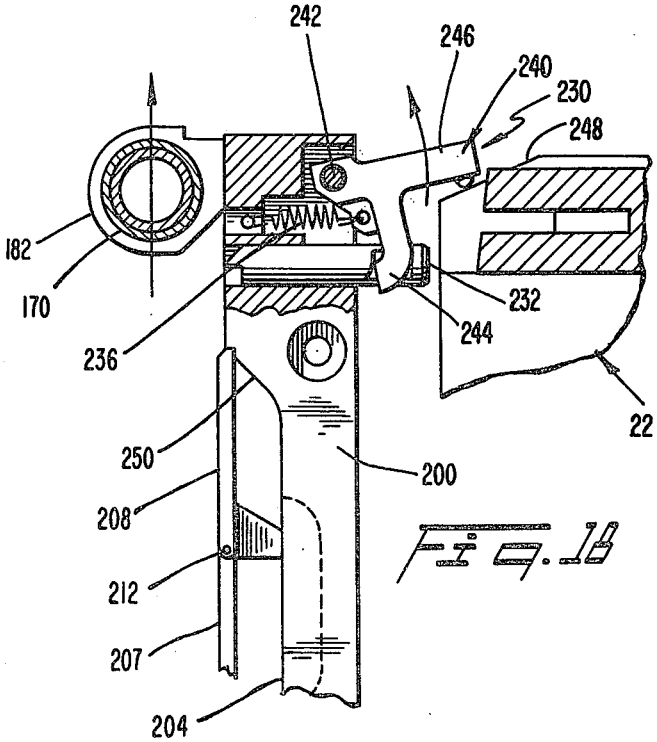
Figure 19:
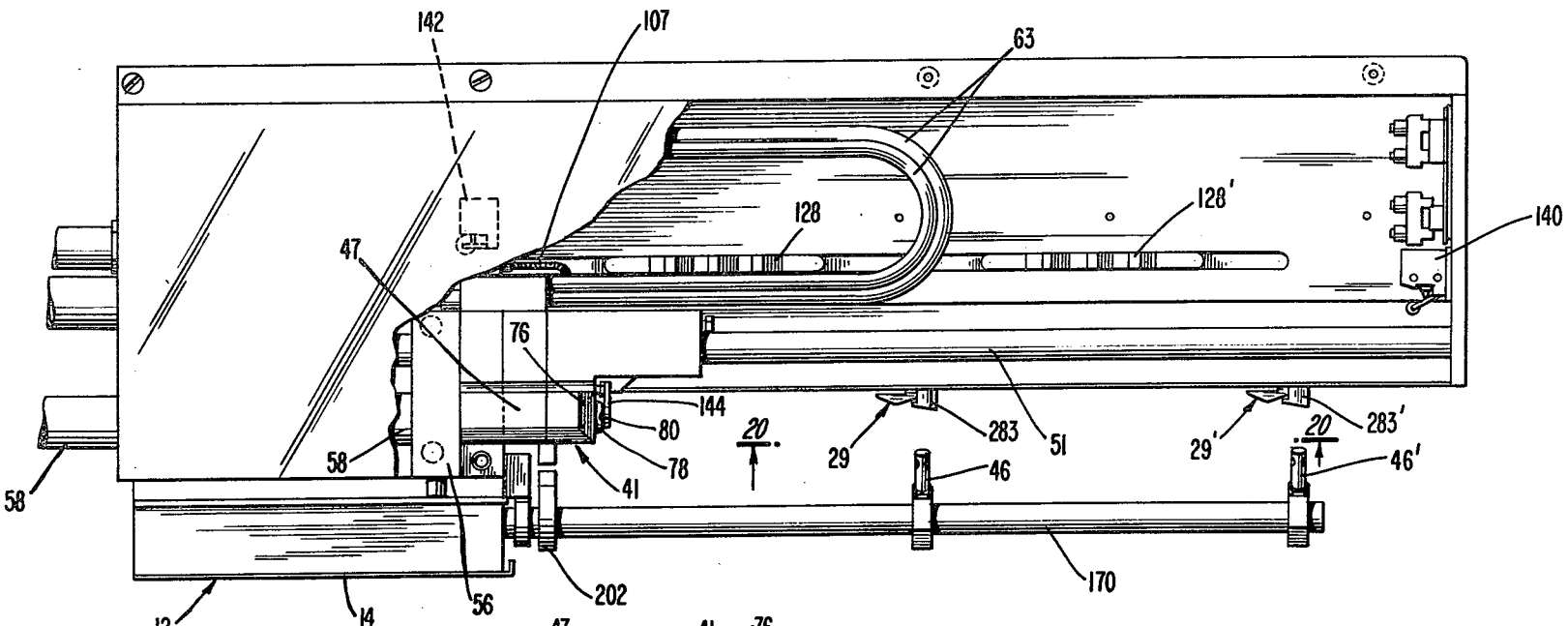
Figure 20:
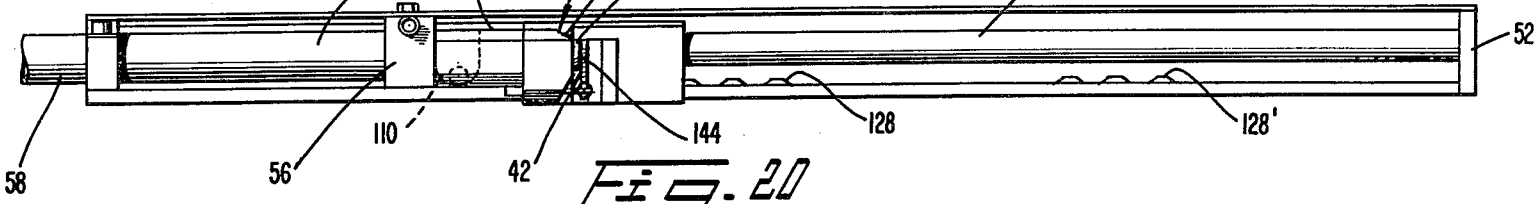
Figure 21:
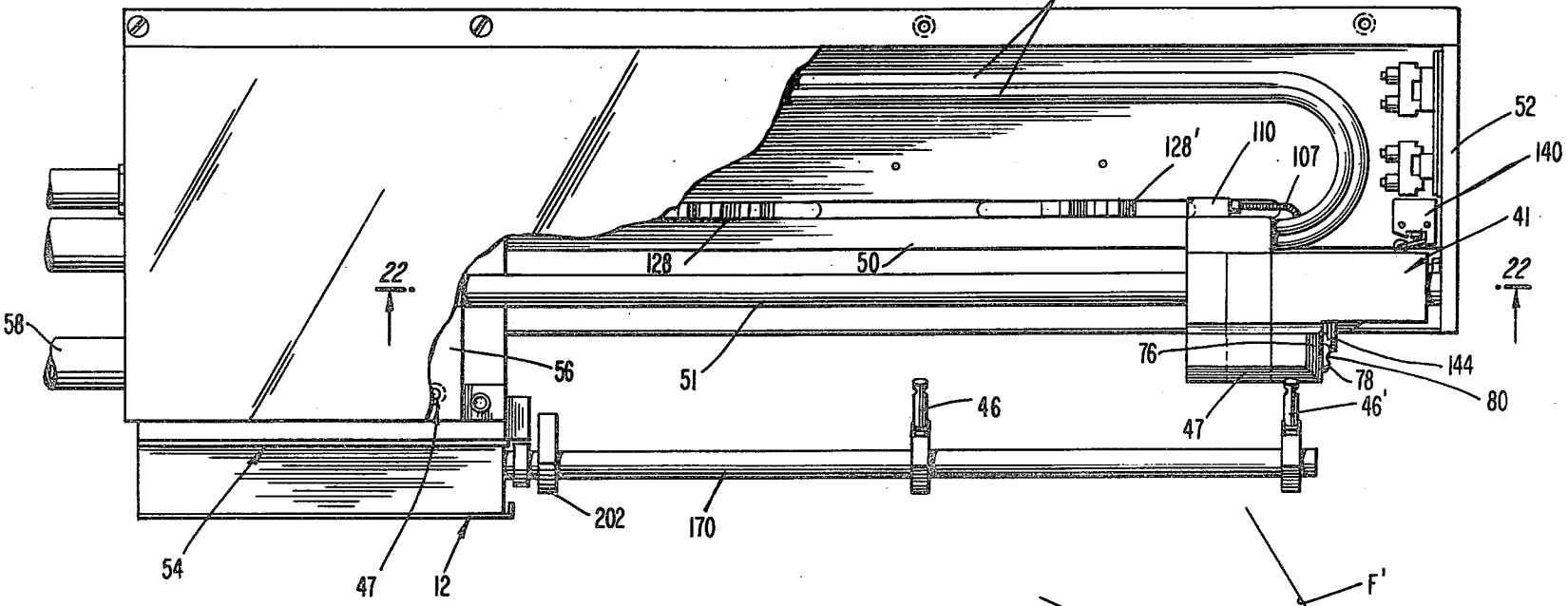
Figure 22:
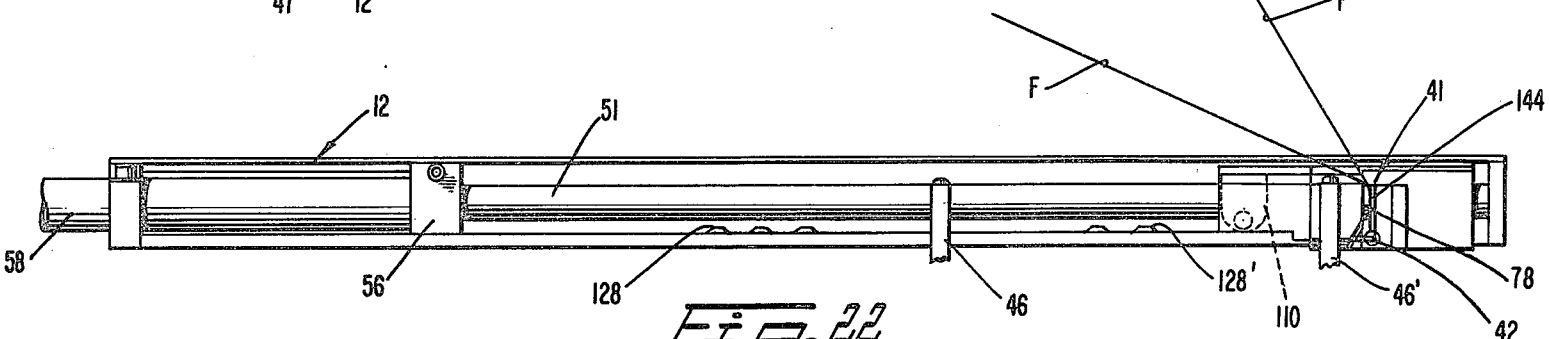
Figure 23:
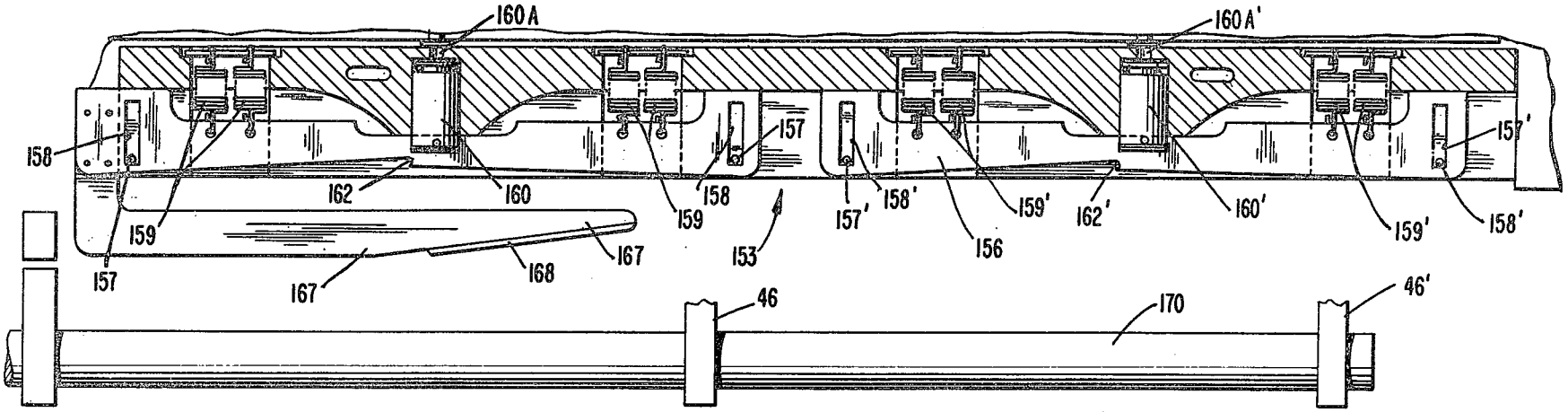
Figure 24:
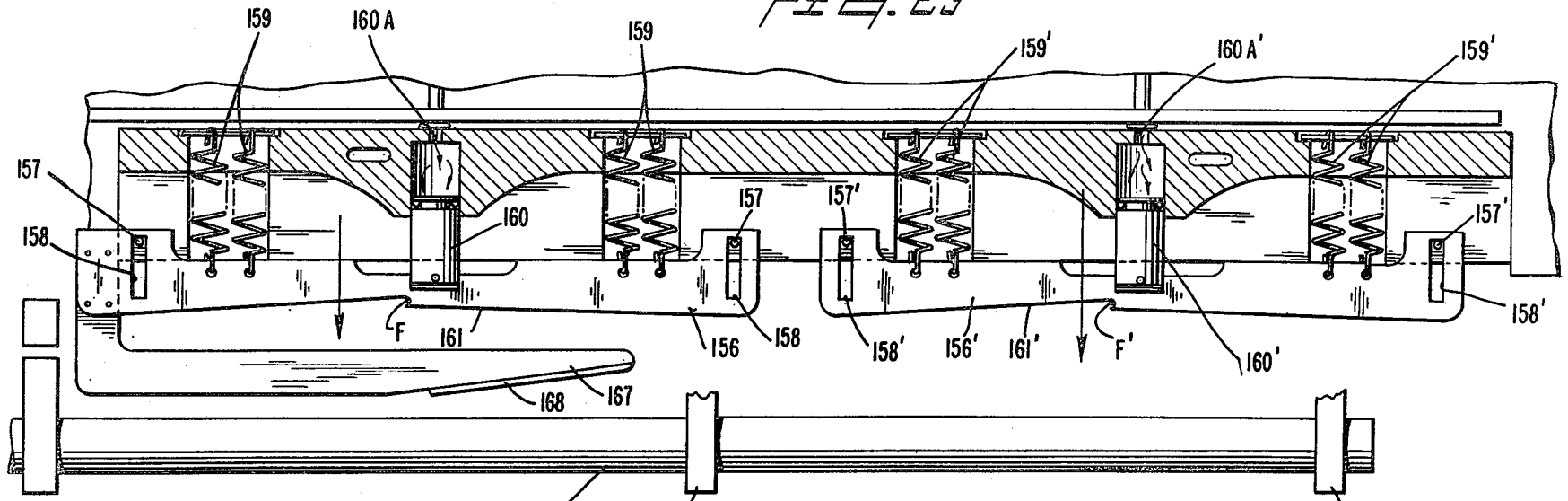
Figures 25, 26:
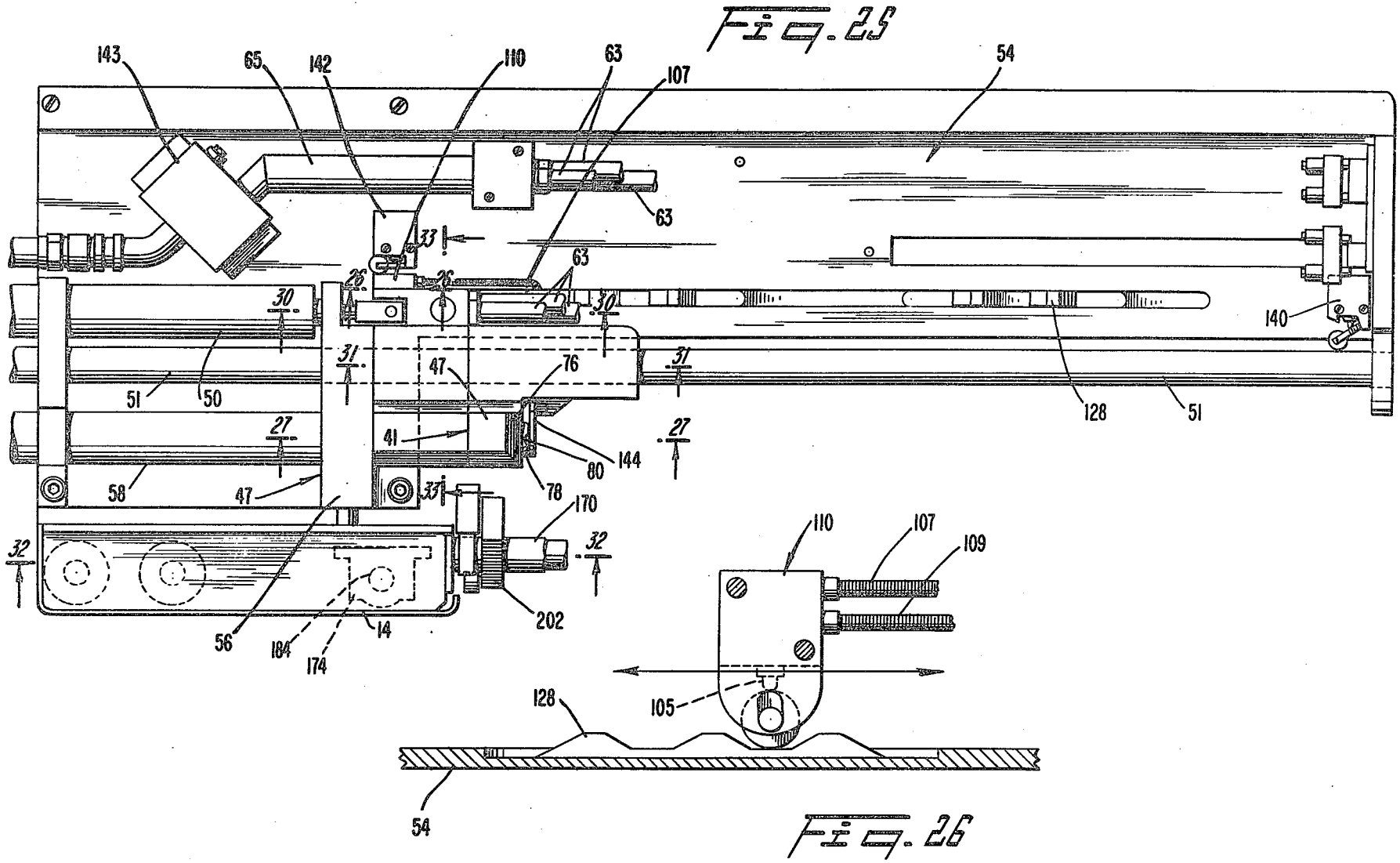
Figure 27:
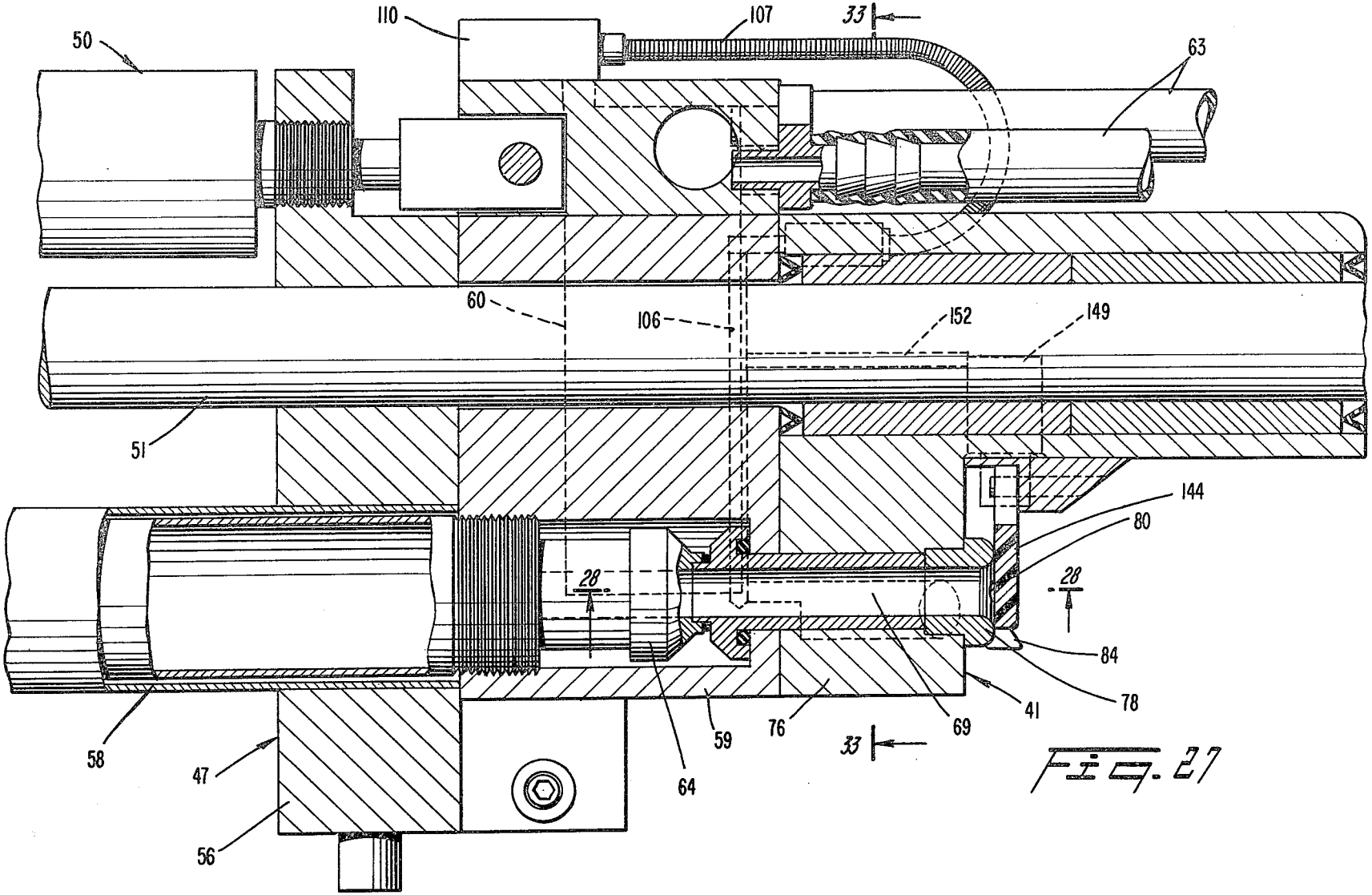
Figure 28:
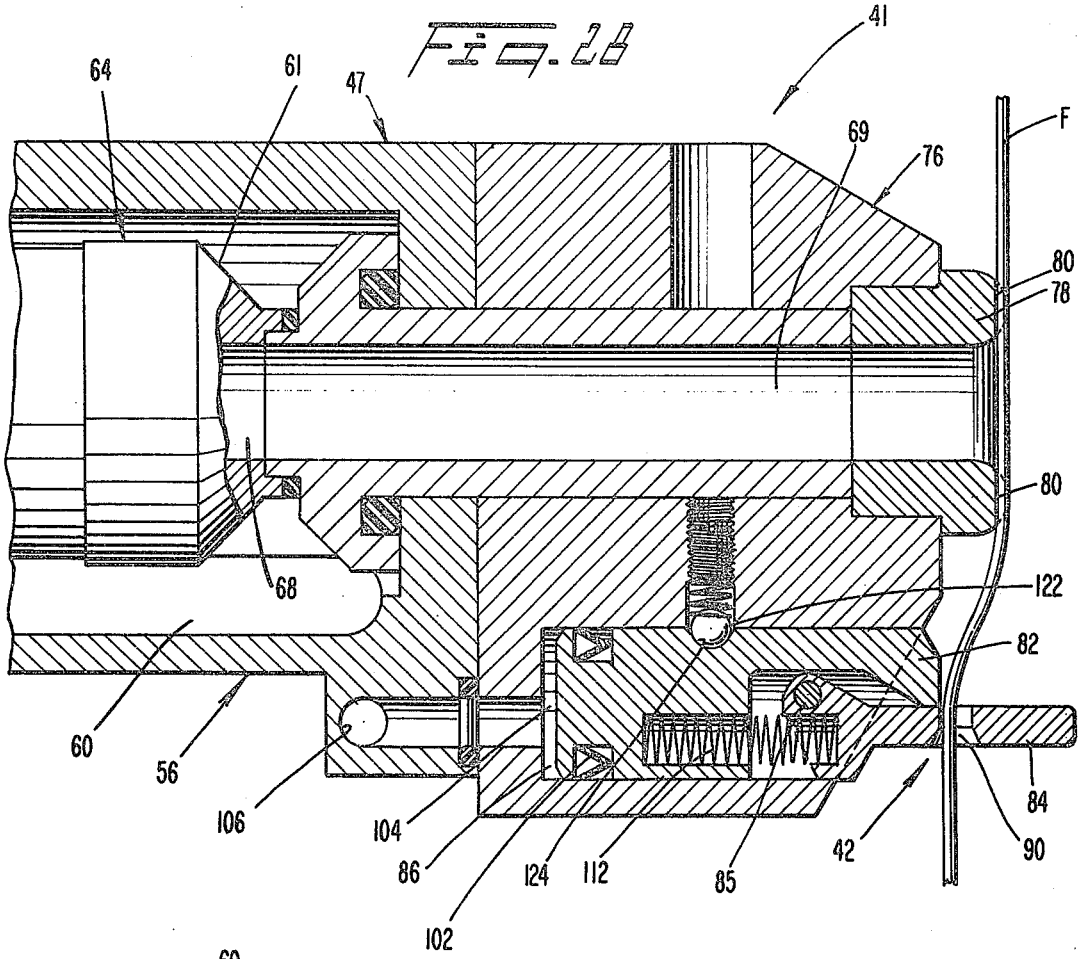
Figure 29:
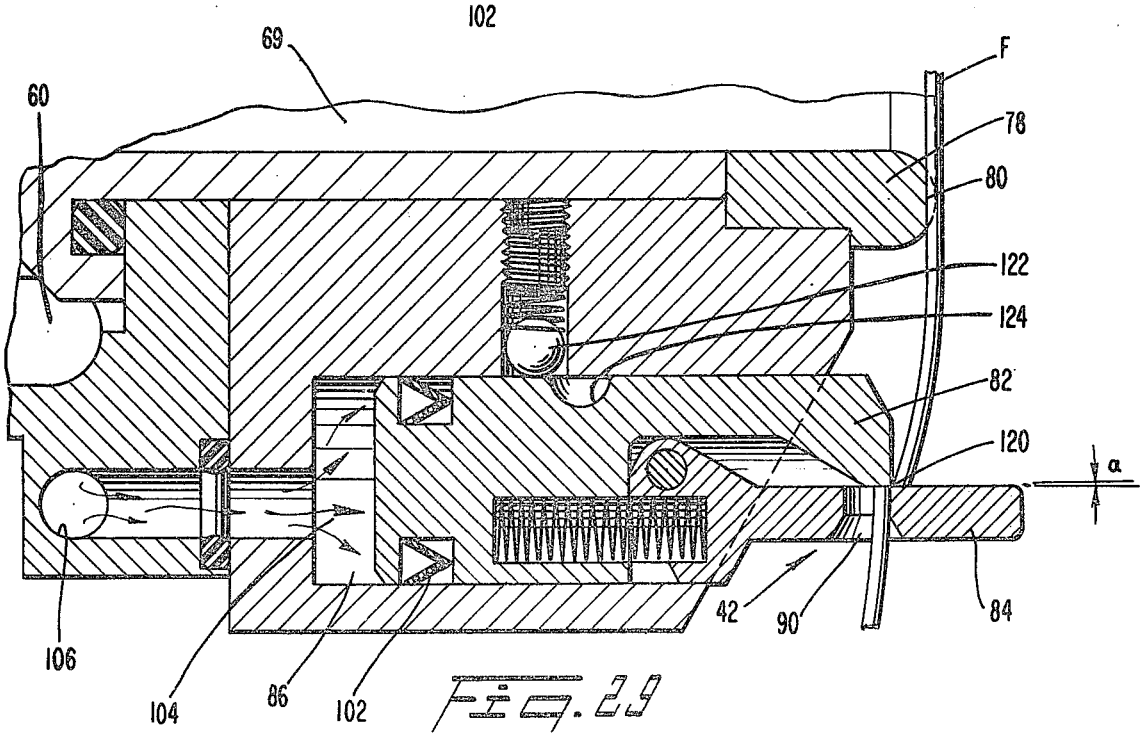
Figure 27:
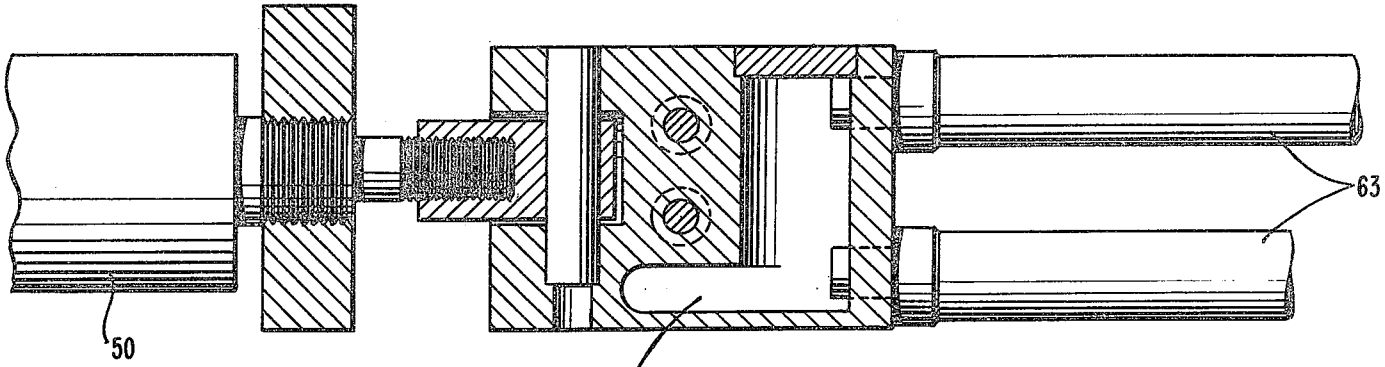
Figure 27:
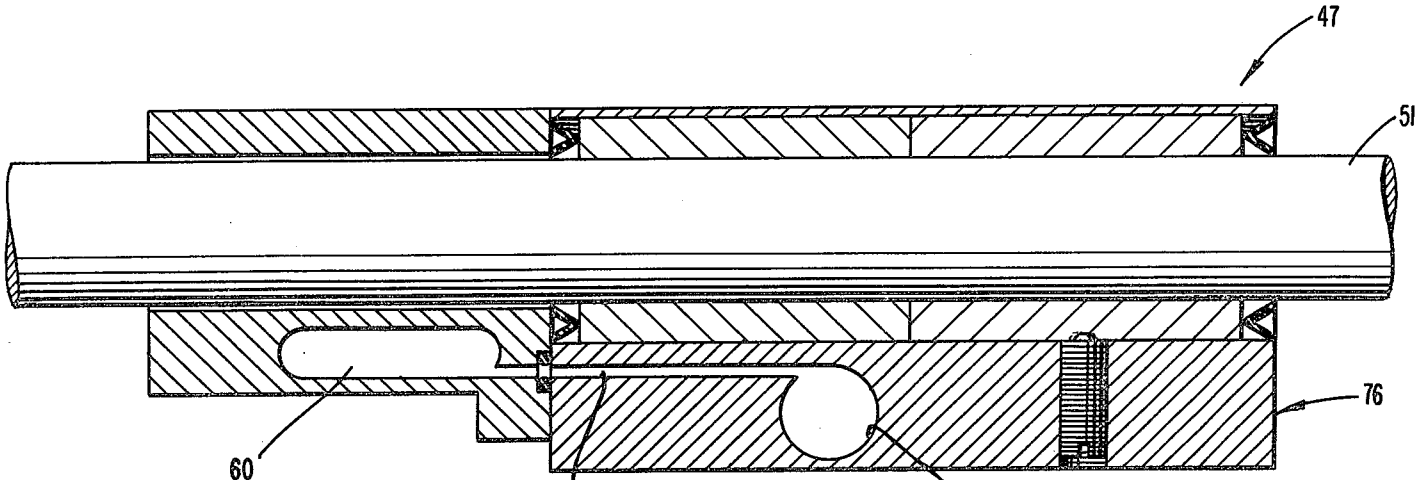
Figure 22:
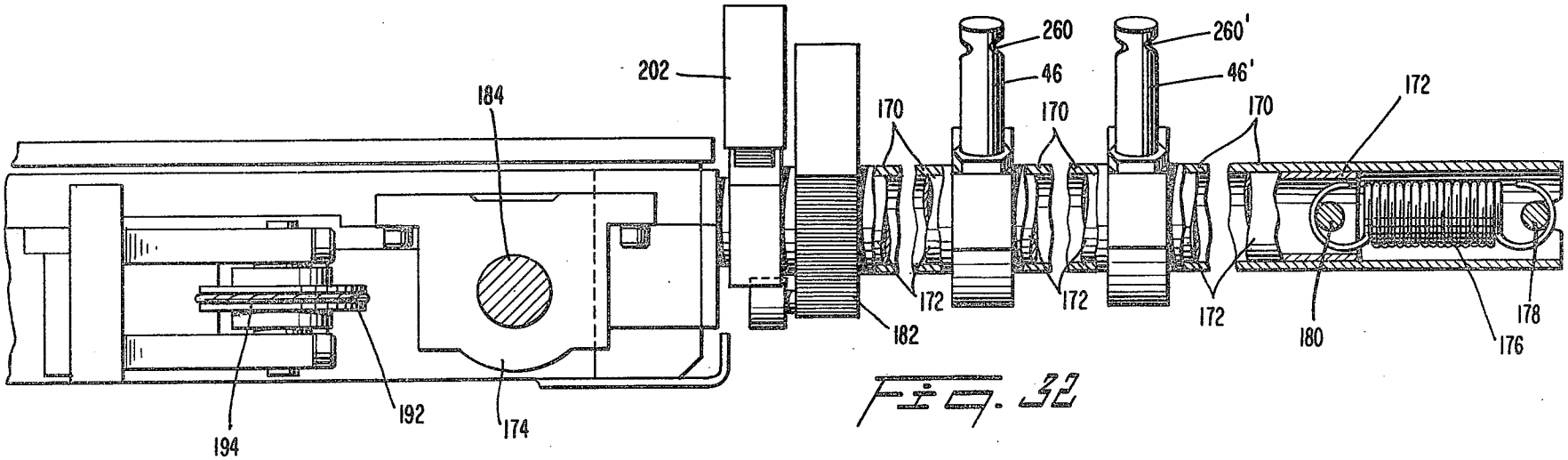
Figure 23:
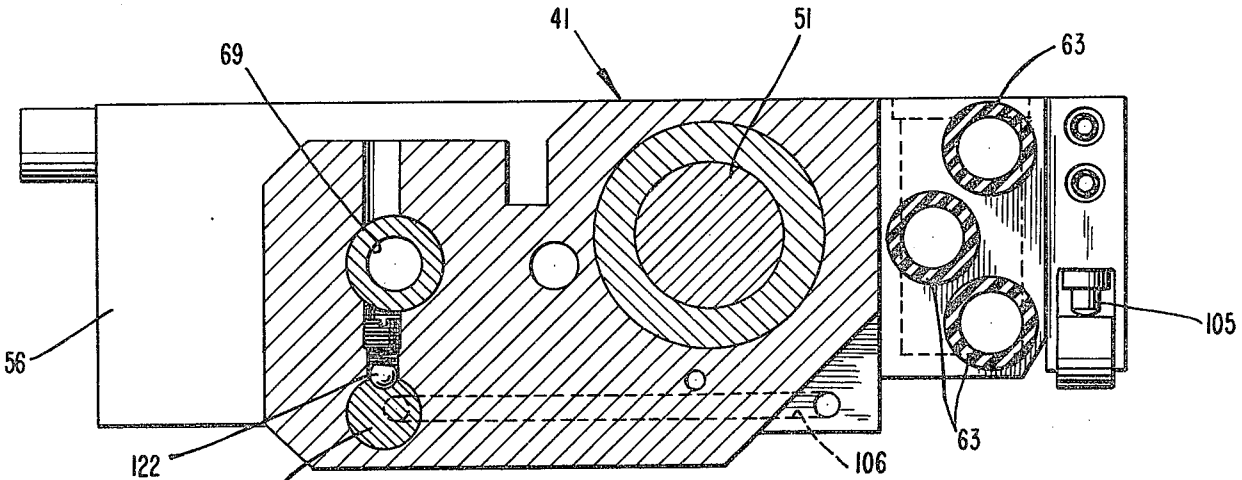
Figure 34:
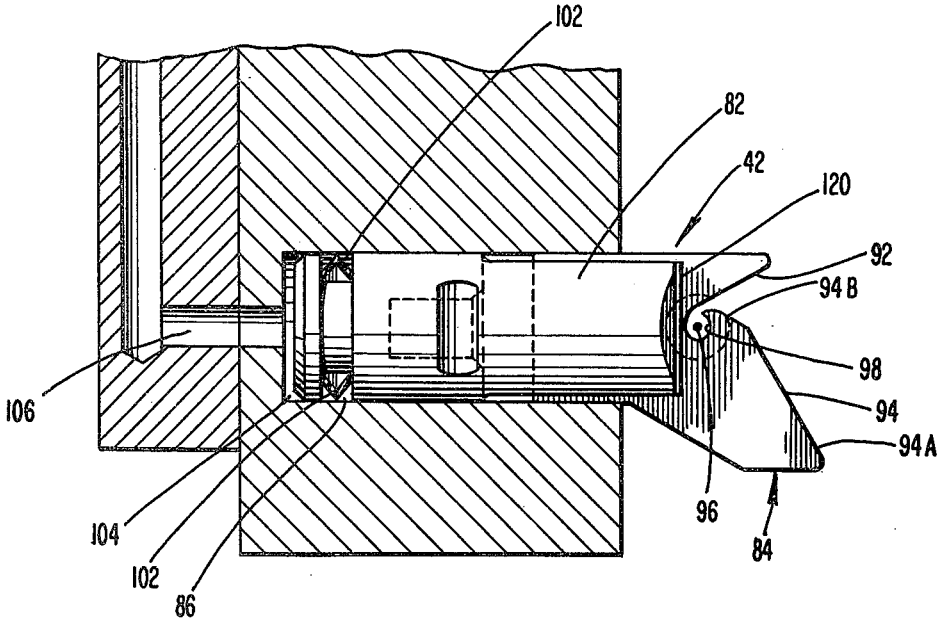
Figure 35:
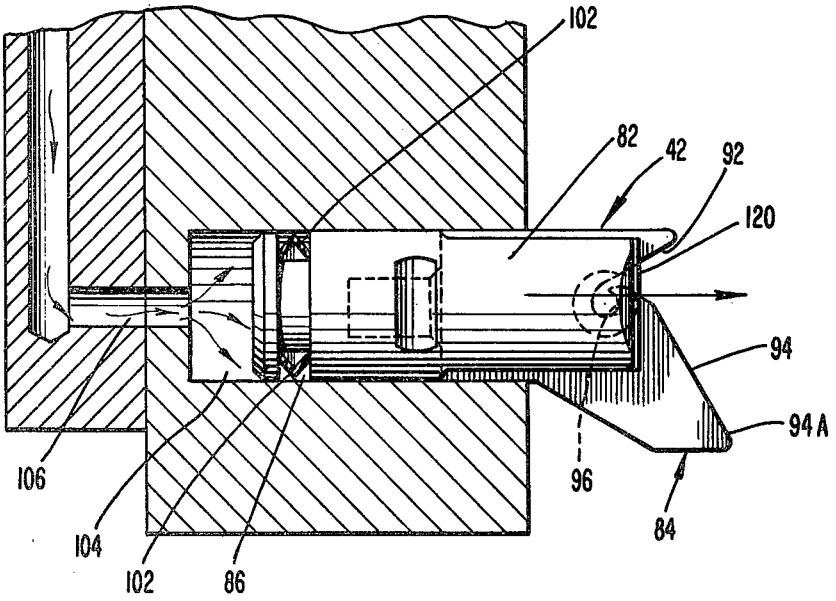
Figure 36A:
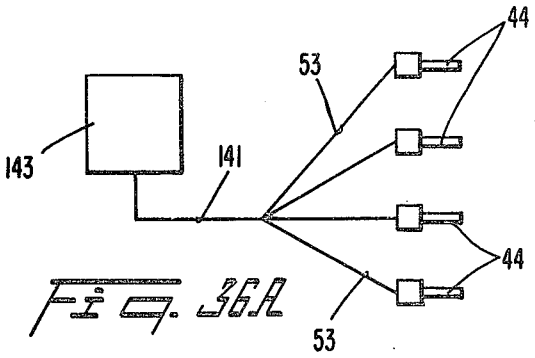
Figure 36:
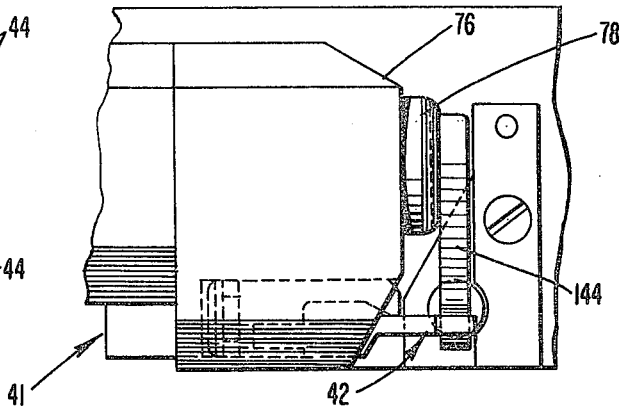
Figure 37:
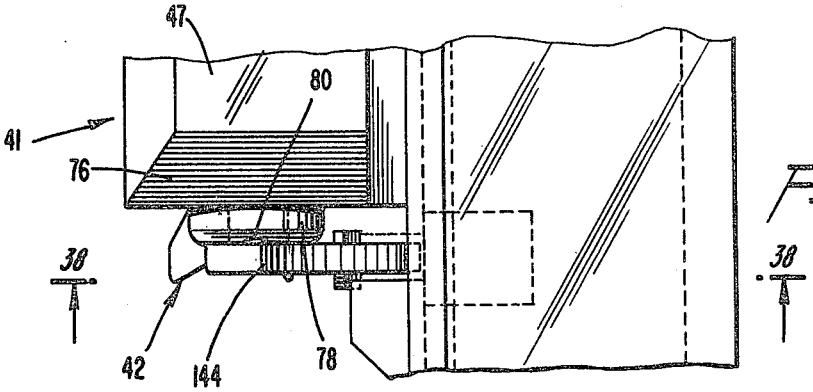
Figure 38:
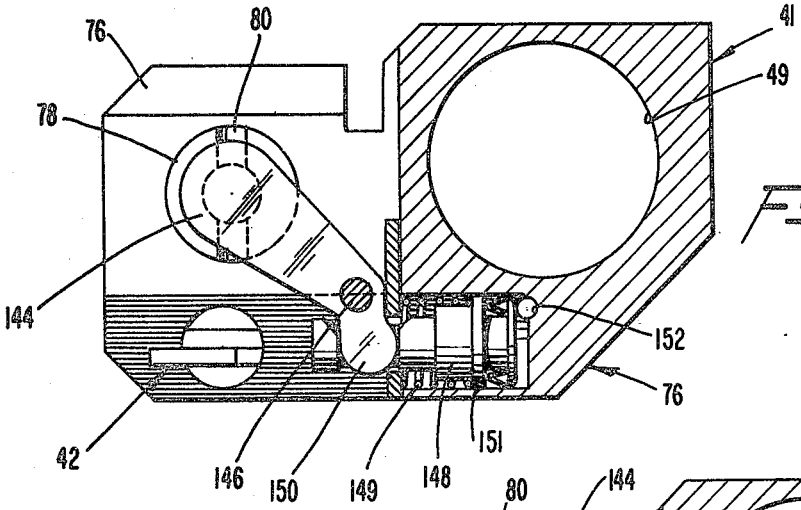
Figure 39:
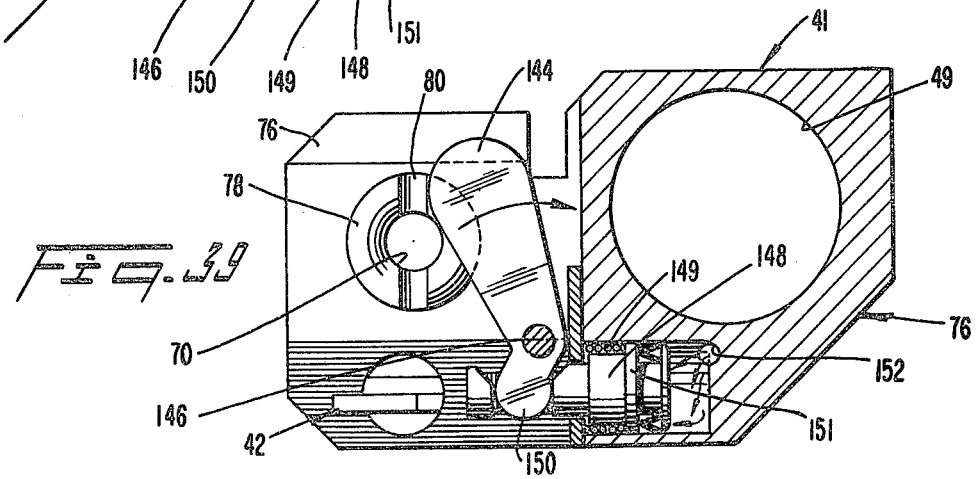
Figure 40:
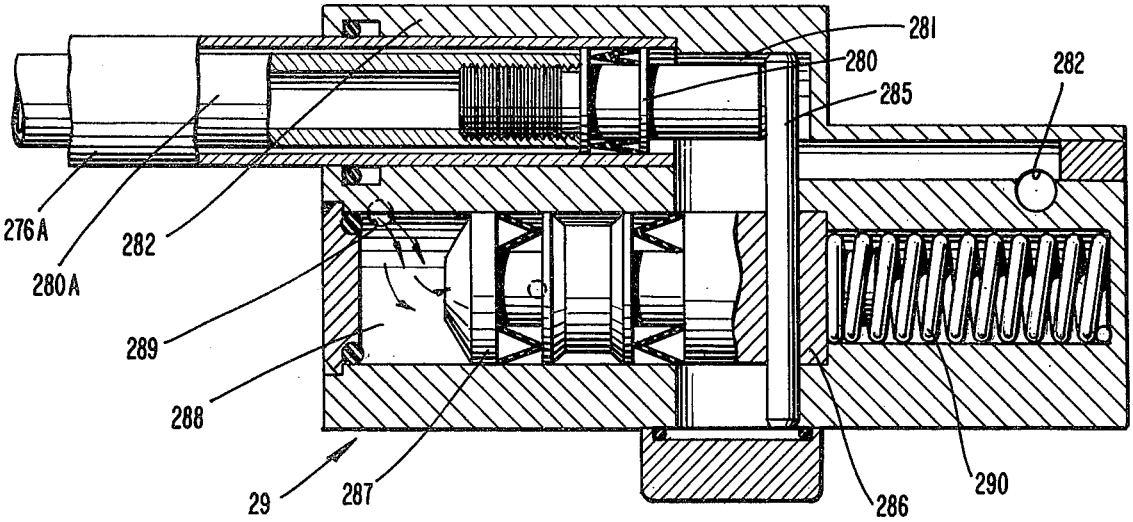
Figure 41:
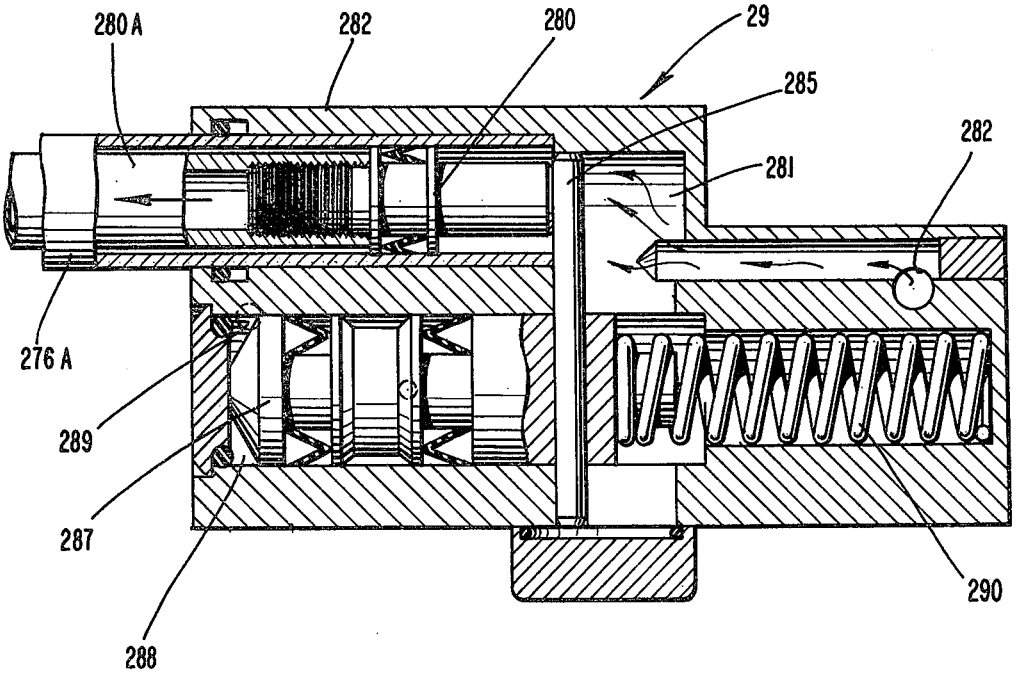
Figures 42, 43, 44:
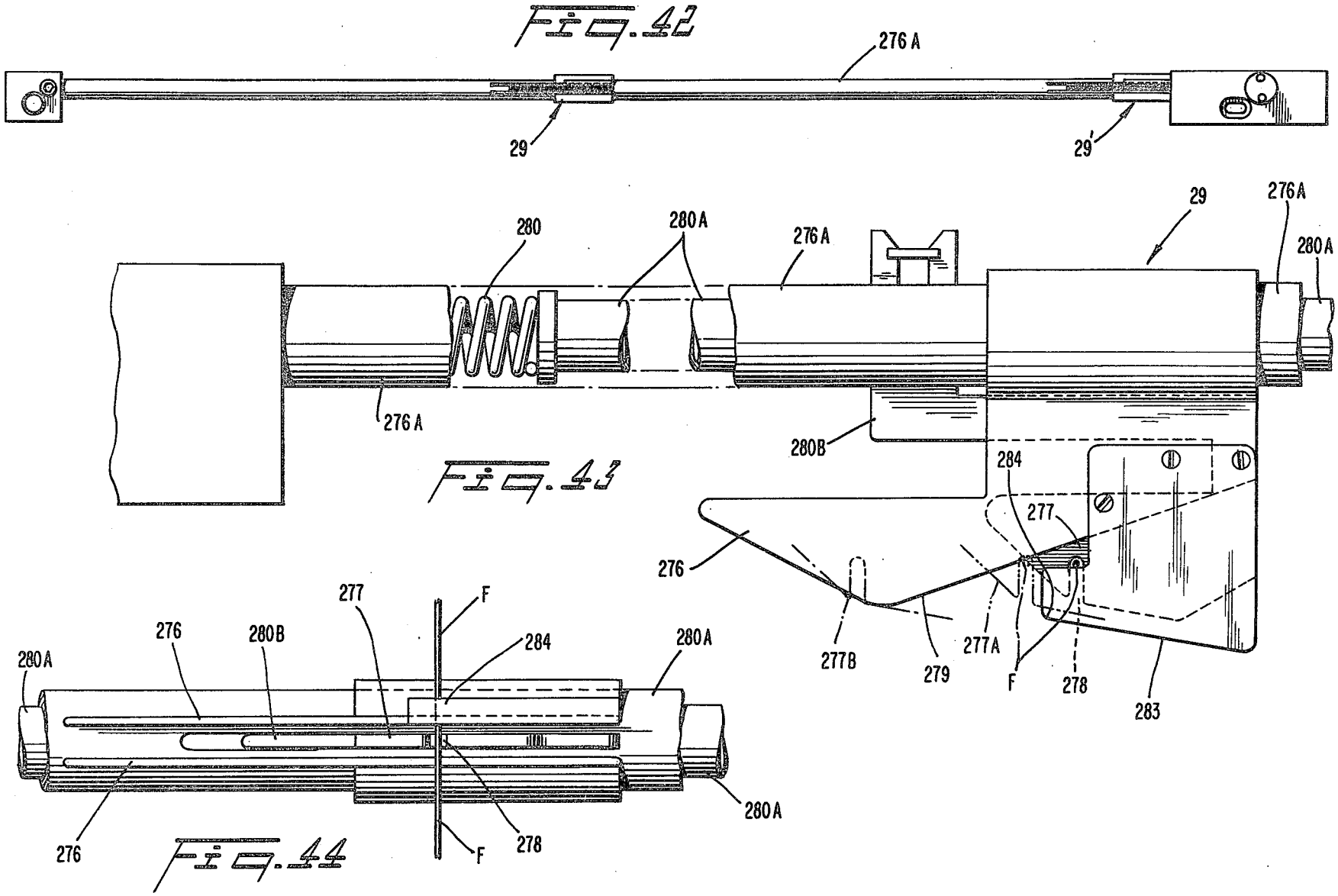
Figure 4S:
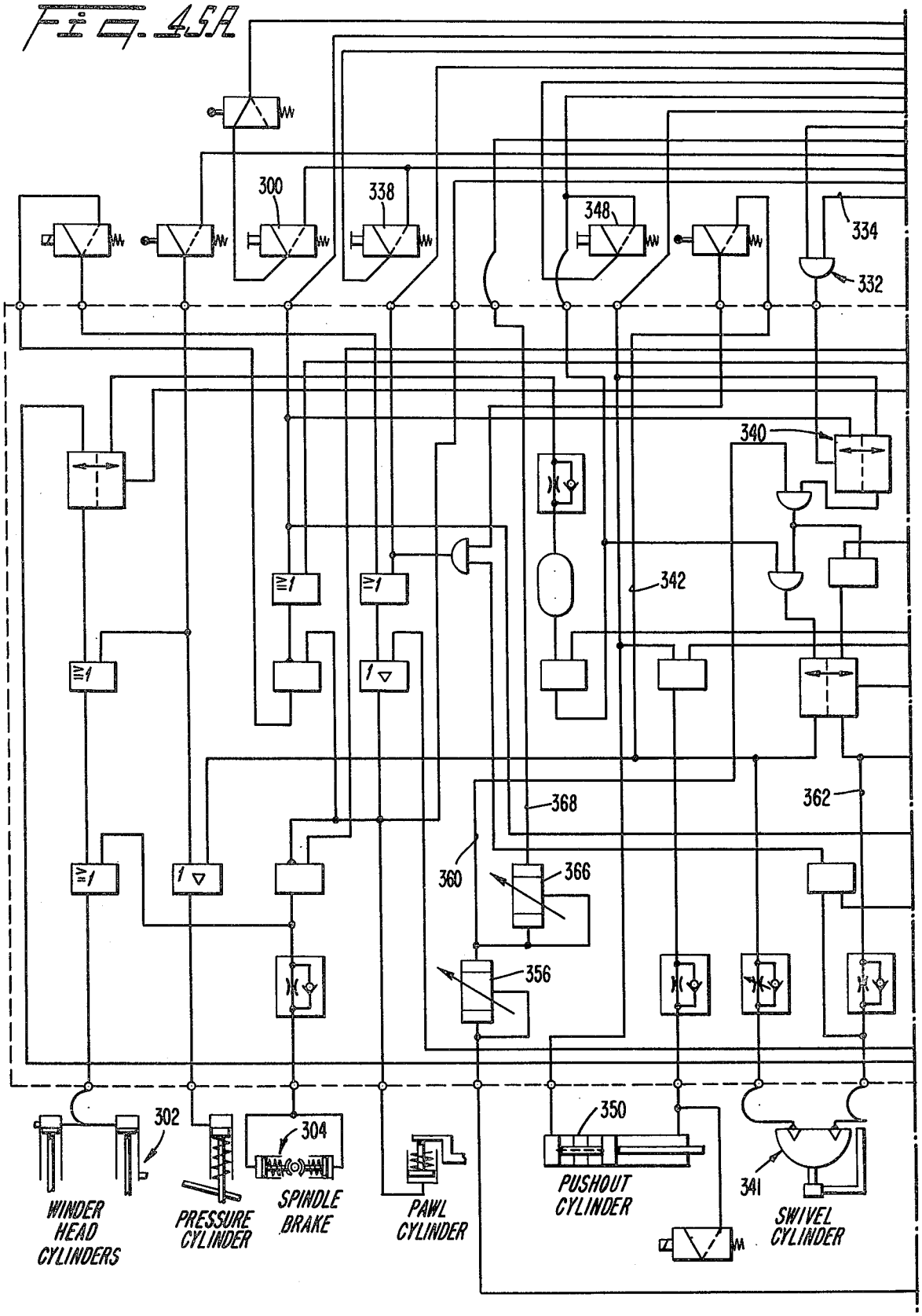
Figure 45B:
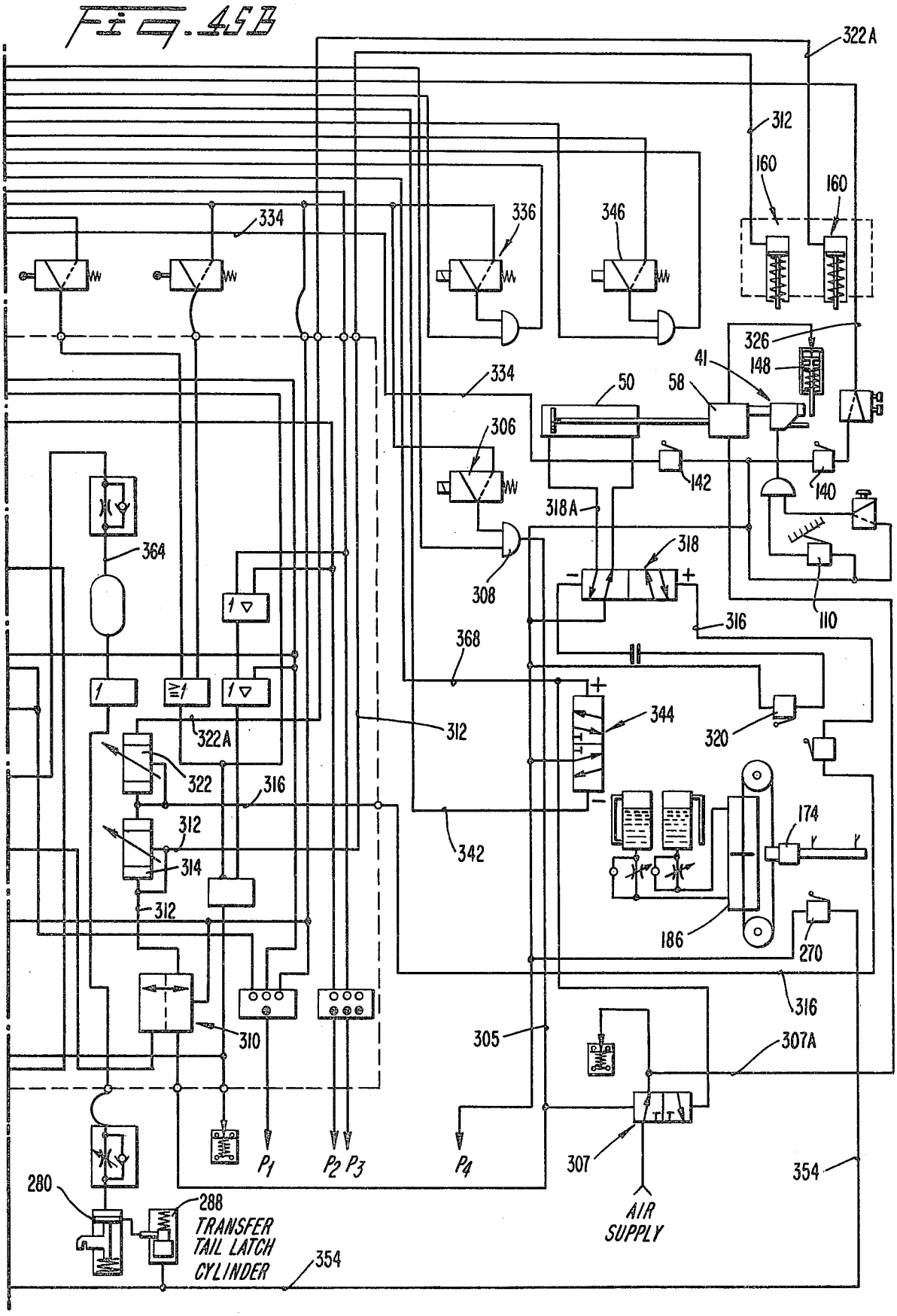

FIG. 11. is a view similar to FIG. 10, depicting the cutter head in its retracted position after cutting and aspirating the yarns, with the yarns having been captured by the transfer arms which are in their forward-most positions;

FIG. 12 is a view similar to FIG. 11 and corresponding to the intermediate position of the transfer arms shown in FIG. 7, wherein the carriage 174 is in the process of riding downwardly along the lower ramp 209;

FIG. 13 is a view similar to FIG. 12 and corresponding to the position of the transfer arms depicted in FIG. 8, wherein the transfer arms are threading the yarns onto the throw-on mechanism of the winder;

FIG. 14 is a front elevational view of the winder and aspirating mechanism corresponding to FIGS. 6 and 11 in solid lines, with the broken lines depicting the condition of the yarns and transfer arms as the latter approach the lower end of their stroke;

FIG. 15 is an enlarged cross-sectional view of the aspirator mechanism corresponding to FIGS. 1 and 4;

FIG. 16 is a fragmentary view of a mechanism which locks the carriage of the transfer arms in an at-rest position, while the winder head is traveling upwardly toward engagement with the locking mechanism to unlock the latter;

FIG. 17 is a view similar to FIG. 15 and after the cutter head has been retracted and the yarn has been captured by the transfer arms;

FIG. 18 is a view similar to FIG. 16 after the winder head has engaged and unlocked the locking mechanism, enabling the carriage to ascend to the position depicted in FIG. 17;

FIG. 19 is a plan view of the winder, with an upper housing wall broken away, depicting the aspirating mechanism in its at-rest position, corresponding to the winder position depicted in FIG. 1;

FIG. 20 is a front view of the winder head viewed in the direction of the plane 20—20 in FIG. 19;

FIG. 21 is a view similar to FIG. 19 after the cutter head has been extended to cut and aspirate the yarn, and after the transfer arms have been rotated to their forward positions;

FIG. 22 is a view similar to FIG. 20 and corresponding to the position of the cutter head depicted in FIG. 21;

FIG. 23 is a horizontal sectional view taken through a portion of the winder, depicting a trailing end control mechanism according to the present invention, with such mechanism disposed in a rest position;

FIG. 24 is a view similar to FIG. 23 after the trailing end control mechanism has been actuated to capture both yarns;

FIG. 25 is a plan view of the winder, with the transfer mechanism removed for clarity, depicting the cutter head in a retracted position;

FIG. 26 is an enlarged fragmentary view of a camming mechanism which controls the actuation of the yarn cutter blades;

FIG. 27 is a horizontal sectional view taken through a portion of the aspirating mechanism, depicting the cutter head in a retracted condition as winding proceeds;

FIG. 28 is a vertical sectional view taken through the cutter head as the latter is in the process of cutting a yarn which has been captured by the lower cutting blade;

FIG. 29 is a view similar to FIG. 28 at the instant when cutting of the yarn has occurred;

FIG. 30 is a vertical sectional view taken along line 30—30 in FIG. 25;

FIG. 31 is a vertical sectional view taken along line 31—31 of FIG. 25;

FIG. 32 is a plan view of the yarn transport mechanism, with a portion thereof broken away;

FIG. 33 is a vertical cross-sectional view taken along line 33—33 in FIG. 25;

FIG. 34 is a horizontal sectional view taken through the cutter head, depicting the cutter blades just prior to a cutting operation, corresponding to the condition depicted in FIG. 28;

FIG. 35 is a view similar to FIG. 34, depicting the condition after a yarn has been severed, corresponding to the view depicted in FIG. 29;

FIG. 36 is a fragmentary side elevational view of the cutter head, depicting a flapper plate in a closed position;

FIG. 36A is a schematic view depicting a pneumatic suction circuit for the aspirator nozzles;

FIG. 37 is a plan view of the cutter head in the position corresponding to the FIG. 36;

FIG. 38 is a front view of the cutter head, corresponding to the position depicted in FIG. 37;

FIG. 39 is a view similar to FIG. 38, after the flapper plate has been swung to an open condition to unblock the inlet passage of the aspirator nozzles;

FIG. 40 is a longitudinal sectional view taken through an actuating mechanism for a tail making device according to the present invention, in the position wherein a yarn is captured within a slot of a tail making guide and is blocked from escape by a gate according to the present invention;

FIG. 41 is a view similar to FIG. 40 as the tail making guide is being advanced toward a position to eject the yarn from the slot;

FIG. 42 is a front elevational view of the tail making apparatus;

FIG. 43 is a fragmentary view in plan of the tail making mechanism, depicting in solid lines the condition wherein a yarn is captured within a slot of a tail maker guide (corresponding to FIG. 40), and depicting other positions of the tail making guide by means of broken lines;

FIG. 44 is a front elevational view of the tail making mechanism, corresponding to the mode depicted in FIG. 43; and FIGS. 45A–45B depict a pneumatic circuitry for the winder and aspirating mechanism.

DETAILED DESCRIPTION OF A PREFERRED EMBODIMENT OF THE INVENTION

Automated Filament Handling Mechanism

A yarn cutter/aspirator 10 according to the present invention is depicted in FIG. 1 in conjunction with a yarn winder 12. The winder comprises a stationary frame 14 from which projects a yarn package axle or spindle 16 (FIG. 3) which supports a pair of conventional removable tubular packages 18, 18'.

Disposed above the spindle 16 is a package drive head 22 which is vertically reciprocably carried by the frame 14. Conventional power mechanisms (not shown) within the frame 14 raise and lower the drive head 22 upon suitable actuation thereof. The drive head 22 includes a helically grooved roll 24 mounted for rotation about an axis parallel to the package axle. During a winder operation, yarns F, F' pass downwardly through overhead guides or godets (not shown) and travel thin the helical guide grooves 26, 26' of the roll 24 and also within horizontally reciprocable traverse guides 28, 28' disposed above the respective grooves. The roll 24 is rotatably driven and the traverse guides 28, 28' are reciprocated parallel to the package axis to achieve a uniform distribution of the cross-wound filaments along the yarn packages.

During such traversing movement, the yarns travel in a common vertical plane, each yarn forming a fan-like pattern. The yarn packages are driven by a drive roll (not shown) mounted on the drive head 22 behind the grooved roll 24. The drive roll rotates the yarn package through frictional contact therewith. As a yarn package fills with wound yarn, the drive head 22 is pushed upwardly by the peripherally accumulating yarn layers while continuing to make peripheral drive contact therewith.

Mounted on the winder above the grooved roll 24 are a pair of tailing guides 29, 29' (FIGS. 40 and 42) which contain slots for receiving the yarns. At the initiation of a winding operation, the tailing guides cause the yarns F, F' to be wound in a manner producing transfer tails on the tubes which facilitate eventual unwinding of the yarn by a user of the yarn.

Disposed at a lower side of the winder is a conventional rod 30 (see FIG. 8) which carries a pair of pig-tail shaped throw-on guides (one guide 32 depicted in FIG. 8). The rod includes a mounting section 30A which is mounted on the drive head 22 for rotation about an axis extending parallel to the package axis. The rod 30 is normally stored behind the winder chuck but can be swung forwardly so that a mounting section of the rod extends parallel to the package axis. The throw-on guides 32, 32' are aligned vertically with respective ones of guide arms 46, 46' to be discussed. During a rethreading operation, the throw-on guides 32, 32' receive the yarns (see the solid line illustration in FIG. 8) and are then swung rearwardly (see the broken line position of FIG. 8) to carry the yarns against the package tube and into pinch slots formed in the tubes, whereupon a new winding operation commences.

In order to remove or doff the packages when the winding operation is finished, it is necessary to sever all the filament(s) in the yarn. Since the source of filamentary yarn supply cannot be shut-off during the doffing sequence, the yarns continue to be supplied and must be carried to storage or waste. After the filled packages are removed from the winder chuck and empty tubes are installed thereon, the yarns must be threaded into the tailing guides 29, 29' and attached to the empty tubes.

In accordance with the present invention, there is mounted to the frame 14 a yarn handling mechanism which automatically cuts the yarns, aspirates the yarns to waste, and rethreads the yarns onto empty tubes. Basically, the yarn handling mechanism comprises a movable gathering head 41 (FIGS. 27, 36–39) which includes a cutter mechanism 42 (FIGS. 34, 35), an aspirator nozzle 44 (FIGS. 27, 36–39), and the pair of guide arms 46, 46' which are movable relative to the gathering head 41 to transfer the yarn to the empty tubes.

The gathering head 41 (FIG. 27) forms part of a reciprocable unit 47 carried at the front end of an extendible/retractible rod portion 48 of a fluid-actuated cylinder 50. The unit 47 includes a bore 49 (FIG. 38) which slidingly receives a cylindrical guide rod 51 (FIG. 27) the ends of which are mounted in front and rear supports 52, 53 (FIG. 21) of a framework 54 disposed above the drive head 22.

The reciprocable unit 47 further includes a bar 56 (FIGS. 21, 27) to which are mounted the front end of the cylinder rod 48 and a front end of a tubular conduit 58 that travels along with the bar. Attached to the bar is a casing 59 in which is disposed a conventional aspirator including a conventional suction-inducing nozzle ring 64. A series of flexible conduits 63 (FIGS. 27, 30) deliver compressed air to a passage 60 in the bar 56, the passage 60 communicating with the tube 58 and the nozzle ring 64 (FIG. 28). Air is thus directed through holes 61 in the nozzle ring 64 and into a central passage 68 of the aspirator tube to create a work suction at the opening 70 of an inlet passage 69 of the air exhaust tube 58. It is noted that three tubes 63 are employed instead of a single larger tube to insure that a sufficient bending of the tubes can be achieved.

The exhaust conduit 58 is slidably disposed within an opening in the rear support 53 of the framework 54 so as to be movable along with the bar 56.

The gathering head 41 includes a housing 76 mounted on the forward end of the inlet passage 69, which sleeve houses the cutter mechanism 42 (FIG. 28) as well as a tip 78 for the opening 70 of the inlet passage 69. This tip is formed of an anti-friction material and includes a vertical slit 80 across the opening 70, which slit receives filaments and locates same relative to the opening 70.

The cutter mechanism 42 is situated in a lower portion of the housing 76 and includes a pair of relatively movable cutter blades 82, 84 disposed within a chamber 86 of the housing 76. One of the cutter blades 84, hereafter referred to as a stationary blade, is freely mounted to the housing by a horizontal pin 85. This stationary cutter blade 84 includes a forwardly projecting portion 88 which forms a yarn-catching slot 90 (FIG. 34). This slot 90 comprises a pair of forwardly diverging side walls 92, 94 communicating at their rear ends with a lateral portion of the slot in the form of a vertical through-passage 96. The through-passage 96 includes a curvilinear front wall 98 which, at an upper surface of the plate, is relatively sharp to form a cutting edge, as will be discussed hereinafter. The lower portion of the through-passage is flared outwardly at 100 (FIG. 29). The wall 94 includes an outer portion 94A and an inner portion 94B, the latter 94B forming a smaller angle with the wall 92 than does the portion 94A.

The other cutter blade 82, hereafter referred to as the reciprocable blade, is mounted for reciprocable movement within the chamber 86 and carries an annular seal 102 to create a fluid-tight work compartment 104 within the chamber 86, which compartment 104 communicates with pressurized fluid, preferably air, via an inlet 106 in the housing 76 and bar 56. This inlet 106 communicates with the air passage 60 by means of a switch 110 (FIG. 27) mounted on the bar 56. By alternately supplying air to, and exhausting air from, the work compartment 104 (in a manner to be described hereinafter), the reciprocable blade member 82 is disposed forwardly and rearwardly. Rearward displacement is effected by means of a spring 112 (FIG. 28), preferably a coil compression spring, which acts against the reciprocable cutter member 82 and a rear end of the yarn-capturing blade member 84. The spring 112 acts against the stationary blade 84 below the pin 85 so that a rotary force (moment) is imparted to the stationary blade 84 tending to press the latter against the reciprocable blade 82. During a cutting stroke, the plane of the stationary blade extends upwardly at an angle a FIG. 29) of from one to three degrees (preferably two degrees) relative to the plane of the stationary blade to assure a line-to-surface contact therebetween and to facilitate self-sharpening of the blades.

The front end of the reciprocable blade 82 includes a sharp edge 120 disposed in sliding contact with the upper surface of the stationary blade 84. Preferably this edge 120 extends perpendicularly to the direction of reciprocation of the blade 82. During a forward stroke of the reciprocable blade, the edge 120 passes completely across the through-passage 96 in the stationary blade 84. Accordingly, a yarn F which is captured within the through-passage is severed by a highly efficient combination scissors/shear action between the straight edge 120 and the curved upper edge of the front wall 98 of the through-passage (FIG. 22). The cross-section of the yarn F is exaggerated in size in FIGS. 19, 22 for clarity.

The interaction occurring between these two edges is enhanced by the action of the spring 112 since the stationary blade is urged upwardly against the reciprocable blade as noted earlier.

In order to assure that a quick, clean severing of the yarn occurs, the reciprocable cutter member is constrained for rapid "snap-like" movement. This is achieved by a spring-biased ball detent 122 (FIG. 28) which engages a recess 124 in the top surface of the reciprocable blade 82 when the latter is in a retracted or rearward position. The detent 122 prevents reciprocable movement of the blade 82 until a selected pressure build-up occurs in the working compartment 104. Thus, instead of there occurring a gradual advance of the reciprocable blade 82 which might result in an uneven, jagged cutting of the moving yarn and resultant unbraiding thereof, a rapid, clean severing occurs.

The through-passage 96 of the stationary blade 84 is disposed rearwardly of the yarn-receiving slit 80 of the aspirator tip 78 to assure that at the instant severing occurs, the yarn F is pressed firmly into the slit 80 and thus suitably positioned for capture by the induced suction at the aspirator inlet 70.

Reciprocation of the reciprocable blade 82 is produced, as noted earlier, by alternately supplying pressurized fluid to, and exhausting it from, the working compartment 104. This is achieved by means of the switch 110 (FIG. 26) which constitutes a conventional roller-type air switch which is actuated by two sets of stationary cams 128, 128' (FIGS. 19, 26) carried by cam bars mounted on the framework 54. The switch 110 receives air via a tube 109 from the air supply conduit 63 (FIG. 26). A spring-biased cam follower arm 105 of the switch 110 (FIG. 26) is arranged to contact and be displaced by the cams 128, 128' as the reciprocable unit 47 is advanced. When displaced, the cam follower arm directs fluid via a tube 107 (FIG. 27) and a passage 106 to the working compartment 104 of the sleeve 76 to urge the reciprocable blade 82 forwardly. Thus, as the switch 110 passes over the first set of cams 128, the reciprocable blade 82 will reciprocate repeatedly to assure that the first yarn F is severed. As the switch 110 passes over the second set of cams 128', the second yarn F' is cut.

Mounted on the framework 54 are a pair of limit switches 140, 142 (FIG. 19) which are contacted and activated by portions of the reciprocable unit 47 to generate appropriate signals when the reciprocable unit is in extended and retracted positions. That is, the first limit switch 140 is activated when the casing is in a fully extended condition, and the second limit switch 142 is activated when the casing is in a fully retracted condition.

The conduits 63 (FIG. 25) which deliver pressurized air from a suitable source are connected to a manifold 65 which, in turn, is connected to a valve 143. The latter is open only when yarn is to be exhausted to waste, i.e., during the doff-donn sequence for the winder in question. Typically, however, a main yarn exhaust conduit 141 (FIG. 36A). to which the suction conduit 58 of the depicted winder as well as a group of additional winders are connected, will continuously impart a suction to the suction conduits 58 by means of a suction generator, such as a fan, to assure that no waste yarn remains in the system.

Suction Gate Mechanism

The aspirator nozzles 44 of a series of winders are connected to a common waste conduit 141 (FIG. 36A) which, in turn, communicates with a suction generator 143. The suction generator creates a waste suction pressure in the common waste conduit 141, so that the waste yarn which is being fed toward the common waste conduit via the respective exhaust conduits 53 can be acted upon and drawn into and through the common waste conduit.

Since the waste suction is being continuously generated and since the common waste conduit is in communication with the inlet passages 69 of the various aspirator nozzles, there has heretofore resulted in a considerable loss of waste suction pressure. As a result, it has been necessary to provide a higher capacity suction generator in order to generate a sufficiently high amount of waste suction for drawing-in the waste yarn from the exhaust conduits 53.

In order to minimize this loss and enable a lower capacity (economical) suction generator fan to be employed, each gathering head 41 is provided with a closure or gate 144 (FIGS. 36–39) disposed at the opening 70 of the inlet passage 69. The closure 144 comprises a valve or flapper plate which is pivoted at 146 intermediate its ends to the gathering head 41. A larger end 147 of the flapper plate is arranged to close-off most of the air opening 70 (except for the ends of the slit 80 in the tip 78) when in a closed position (FIG. 38). Actuation of the flapper plate is effected by an air piston (FIG. 38) mounted for reciprocation in a chamber 149 in the housing 76. A smaller end 150 of the flapper plate is received within an opening at an outer end of the piston 148 so that the piston is capable of oscillating the larger end of the flapper plate to and from the air opening 70. A coil compression spring 151 biases the piston inwardly to a plate-closing condition. Pressurized air admitted to the chamber 149 via a passage 152 to extend the piston against the spring-bias and uncover the inlet 70. The passage 152 communicates with the passage 60 (FIG. 31). Thus, at the same time that the valve 143 actuates the aspirator 64, pressurized air is bled from the passage 60 to extend the piston 148 and unblock the opening 70. By covering the inlet passage 69 during periods of inactivity of the yarn cutter/aspirator, it is assured that the loss of waste suction is minimized.

Trailing End Control Mechanism

It will be appreciated that upon extension of the gathering head 41, the yarns F and F′ are sequentially severed and aspirated to waste. In accordance with the present invention, just prior to the severing of each yarn, such yarn is acted upon in a manner producing a tight, close-order winding of the yarn on the package which resists subsequent unraveling of the yarn when the drive head 22 of the winder lifts-off the packages 18, 18′.

This is achieved by a yarn trailing end control mechanism 153 (FIGS. 1, 23, 24) which is mounted on the winder drive head 22 upstream of the traverse guides 28, 28′, i.e., above such guides in the preferred embodiment. The trailing end control mechanism 153 comprises a housing 154 which forms a horizontal slot 155 opening toward the plane of yarn travel.

Mounted for horizontal reciprocable movement within the slot 155 are a pair of yarn control plates or deflector arms 156, 156′ (FIG. 23). These control plates are guided by means of pins 157, 157′ which are fixed on the housing 154 and are received in slots 158, 158′ in the control plates. A plurality of coil tension springs 159, 159′ act between the control plates 156, 156′ to normally bias the control plates into the slot 155. Air actuated pistons 160, 160′ are mounted for horizontal reciprocable movement within the housing 154 and are connected to respective ones of the control plates 156, 156′ to urge same sequentially (not simultaneously) outwardly from the slot 155 when pressurized air is conducted to rear ends of the pistons via passages 160A, 160A′.

When this occurs, the front contact edges 161, 161′ of the respective plates 156, 156′ push the associated yarns F, F′ in a direction away from the drive head 22 and out of the traverse guides 28, 28′. The kicked-out yarn continues to be moved parallel to the package axis by the grooved roll 24 until becoming caught in a stop notch 162, 126′ in the respective front edge 161 or 161′. At this point, the yarn is constrained by the notch and by circumferential nonhelical grooves 163, 136′ (FIG. 1) in the grooved roll 24 which are aligned vertically with the notches 162, 162′. The thus-controlled yarns F, F′ are constrained to wrap around the packages 18, 18′ in close order to form a more tightly adhered winding which is less susceptible to being unraveled when the drive head 22 subsequently lifts-off the packages 18, 18′.

Since the yarns are pushed out of the traverse guides 29, 29′, the yarns are not subject to flutter, which could dislodge the yarns from the notches 162 or 162′. Moreover, the structure of the plates is quite compact and quite simple since such plates 156, 156′ only occupy a small space above the traverse guides.

The control plates 156, 156′ are actuated sequentially by their respective air pistons 160, 160′ so that an equal amount of yarn is wrapped on each package. That is, actuation of the control plates 156, 156′ is coordinated with the actuation of the cutter head 41. The time period from the actuation of the first control plate 156 to the cutting of its associated yarn F is substantially the same as the time period from the actuation of the second control plate 156′ to the cutting of its associated yarn F′.

Attached to the first control plate 156 is a deflector arm 167. This arm extends across the front of the slot 155 but is spaced therefrom when the first control plate 156 is held retracted within the slot 155. The function of the deflector arm 167 is realized after the yarns have been severed and new yarns are being transported toward empty packages, as will be explained hereinafter. The outer edge 168 of the deflector arm, preferably coated with an anti-friction substance, engages portions 169 of those new yarns (FIG. 14) toward the winder and out of contact with the traverse guide, until threading onto the empty packages has been achieved.

Operation of Gathering Head and Trailing End Control Mechanism

The operation of the gathering head 41 commences at the termination of a winding step, i.e., when it is time to doff the filled packages 18, 18'. At such time a signal is sent, either by an operator pushing a "stop" button (FIG. 3) on the winder 10 or perhaps by a computer in an automated plant, which causes the first air piston 160 to extend the first control plate 156 and displace the first yarn F from its traverse guide 28. Thereafter, the first yarn F winds in close-order upon the first package 18, as controlled by the notch 162 in the control plate 156 and by the trailing groove 163 in the groove roll. After a preset period, the fluid cylinder 50 of the yarn handling mechanism is actuated to extend the gathering head 41 forwardly. The gathering head 41 is positioned such that the yarn capturing slot 90 (FIG. 34) of the stationary blade lies within the generally vertical plane occupied by the yarn F after such yarn has been displaced from the traverse guide 28 by the control plate 156. The front end or mouth of this yarn-capturing slot 90 is made large enough to accommodate slight displacements of the yarn from such common vertical plane. Thus, it is assured that eventually, as the gathering head 41 advances, the first yarn F will enter the slot 90 and become captured in the through-passage 96. At the same time, the yarn F becomes confined within the vertical slit 80 in the aspirator tip 78 (FIG. 28) and is thus aligned with the suction inlet 70.

When the switch 110 on the bar 56 (FIG. 26) begins making contact with the first set of cams 128, pressurized fluid is intermittently supplied to the working compartment 104 (FIG. 28) in the gathering head 41 to build-up pressure therein and overcome the bias of the ball detent 122. When that occurs, the reciprocable blade 82 snaps-out (FIG. 29) and its cutter edge 120 passes across the through-passage 96 and severs the yarn F. The spring 112 urges the stationary blade 84 firmly against the reciprocable cutter edge 120 to produce a clean cut through the yarn. It will be appreciated that the cutter operates in response to each cam signal regardless of whether severing has occurred or not. A sufficient number of cams 128 are provided to enable sufficient opportunity for the yarn to be captured in the slot 90, 96 and still be severed.

When severed, the yarn F is immediately caught-up in the continuously induced suction at the aspirator inlet 70 and is conducted to waste via the air outlet tube 60.

The gathering head 41 continues forwardly and performs a similar severing of the second yarn F'. Thus, both yarns F, F' are being exhausted to waste, enabling the packages 18, 18' to be replaced, either manually or by an automated robot. Prior to severing of the second yarn F', the second control plate 156' is extended by its associated piston 160', causing the second yarn F' to be caught in the notch 162'. Accordingly, the second yarn F' is wound tightly upon its package before being severed.

At the forward end of the stroke of the gathering head 41, the limit switch 140 is activated and signals the drive head 22 to rise, thereby breaking the drive connection to the yarn packages which are then automatically braked in conventional fashion.

Yarn Transfer Mechanism

Prior to retraction of the gathering head 41, the aforementioned guide arms 46, 46' of the transfer mechanism are displaced toward the vertical yarn plane (FIG. 17) and the arrangement of such guide arms 46, 46' shall now be discussed in more detail.

Figure 2:
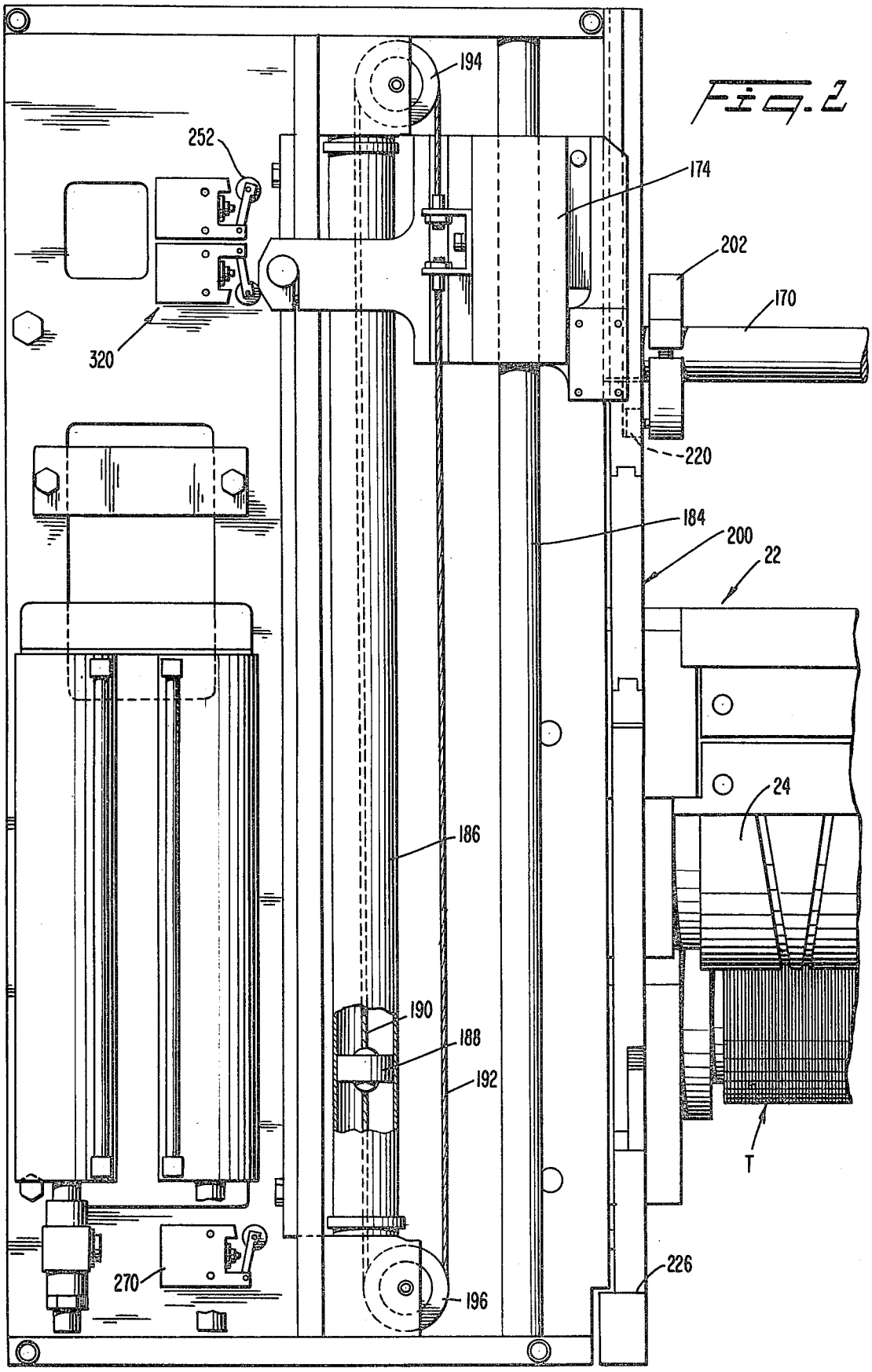
FIG. 2 is a front view of a mechanism for raising and lowering a yarn transport mechanism of the present invention, with the yarn transport mechanism disposed in an upper mode.

The guide arms 46, 46' are affixed to a hollow shaft 170 (FIGS. 1 and 32) which is oriented parallel to the package axis. This shaft 170 is rotatably mounted on a coaxial bar 172 which is, in turn, affixed to a vertically traveling carriage 174 (FIG. 2). The shaft 170 rotates relative to the bar 172 about the common longitudinal axis thereof. A spring, preferably a coil spring 176, is connected between the free ends of the shaft and bar by means of pins 178, 180 carried thereby, to bias the shaft (a) rotationally to a position wherein the guide arms 46, 46' are in a rest condition out of the vertical yarn plane, and (b) longitudinally inwardly against a stop element 182 on the bar to properly locate the guide arms along the axis of the shaft. The rotational positioning of the shaft 170 is determined by the spring 176 in conjunction with cam surfaces 202, 204, 206 as will be discussed.

The carriage 174 is mounted for vertical sliding movement upon a stationary upright pole 184. Oriented in an upright position adjacent the pole 184 is a conventional fluid-actuated cable cylinder 186 which includes an internal fluid-actuated piston 188 and cables 190, 192 extending from opposite sides of the piston 188 and passing through seals (not shown) at ends of the cylinder 186. Each cable 190, 192 passes around a free-wheeling pulley 194, 196 and is connected to the carriage 174 such that movement of the piston 188 in one direction creates movement of the carriage 174 in the opposite direction.

Figure 3:
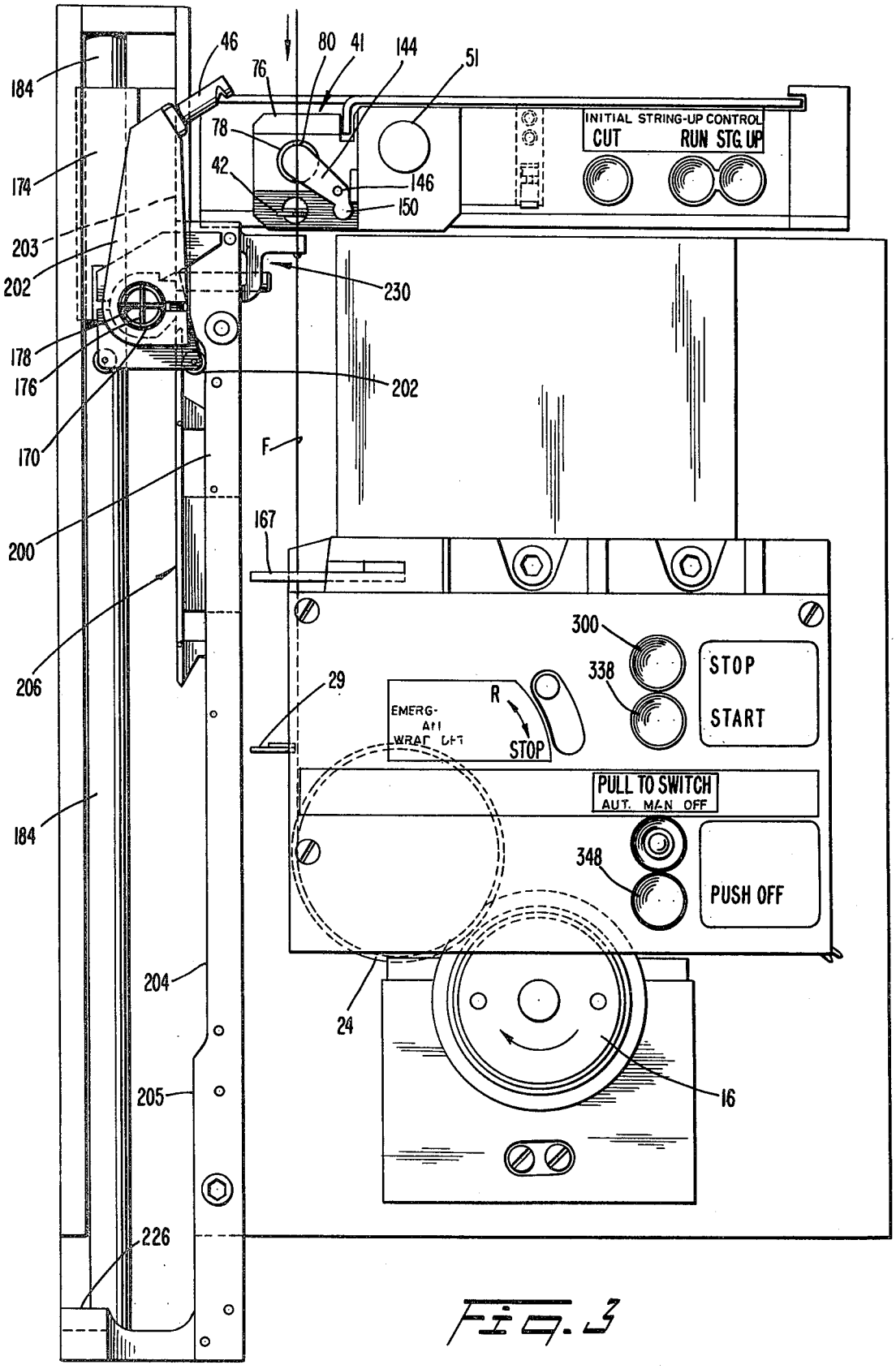
FIG. 3 is an end view of the winder depicted in FIG. 1.

Mounted on the frame 14 adjacent an inner end of the shaft 170 is a stationary cam bar 200 (see FIGS. 3 and 15). The cam bar 200 defines upward and downward paths of travel for a cam follower 202 fixedly mounted on the shaft 170 to control the positions of the guide arms 46, 46' as they ascend and descend. The cam bar 200 forms three straight surfaces 203, 204, 205 separated by a pair of inclined surfaces. An escapement track assembly 206 has a surface 207 arranged to form a general extension of the first straight surface 203. The escapement track comprises a stationary middle section 207 and upper and lower swingable ramps 208, 209. The middle section 207 is attached to the cam bar 200 by means of a mounting plate 210. The upper and lower ramps 208, 209 are swingably mounted to the ends of the middle section by means of pivot pins 212, 214. Coil springs 216, 218 are provided to bias each ramp to a position aligned with the middle section. The upper ramp 208 is capable of swinging only away from the cam plate 200 (i.e., counterclockwise in FIG. 15), whereas the lower ramp 209 is able to swing only toward the cam bar 200 (i.e., counterclockwise in FIG. 15). The coil springs 216, 218 which bias the ramps 208, 209 are each weaker than the force of the spring 176 (FIG. 32) which biases the shaft 179; thus, the former springs 216, 218 yield to the latter 176.

The cam follower 202 has a wheel 220 which is normally biased toward the cam bar 200 by the spring 176. When the follower wheel is disposed in contact with the topmost straight surface 203 (FIG. 17), the free ends 222, 222' of the guide arms 46, 46' are located in their forwardmost position toward the winder, i.e., they extend at least as far as the yarn plane at a level above the path of travel of the gathering head 41. When the follower wheel 220 is in contact with the intermediate straight surface 204 (FIG. 4), the free ends 222, 222' of the guide arms 46, 46' are disposed rearwardly of the plane of the yarns. This enables the guide arms 46, 46' to descend in an unobstructed manner. When the follower wheel 220 is in contact with the lowermost straight surface 205 (FIG. 7), the free ends of the guide arms 46, 46' are located closer to the winder drive head 22 to thread yarns into the tailing guides 29, 29'.

At the bottom of the stroke of the follower (FIG. 8), a second cam wheel 224 thereof contacts a cam projection 226 of the cam bar which rotates the guide arms 46, 46' (clock-wise in FIG. 8), to bring the free ends 222, 222' of the guide arms to a forward position beneath the winder grooved roll 24 to thread the yarns into the pig-tail guides 32, 32'.

Figure 5:
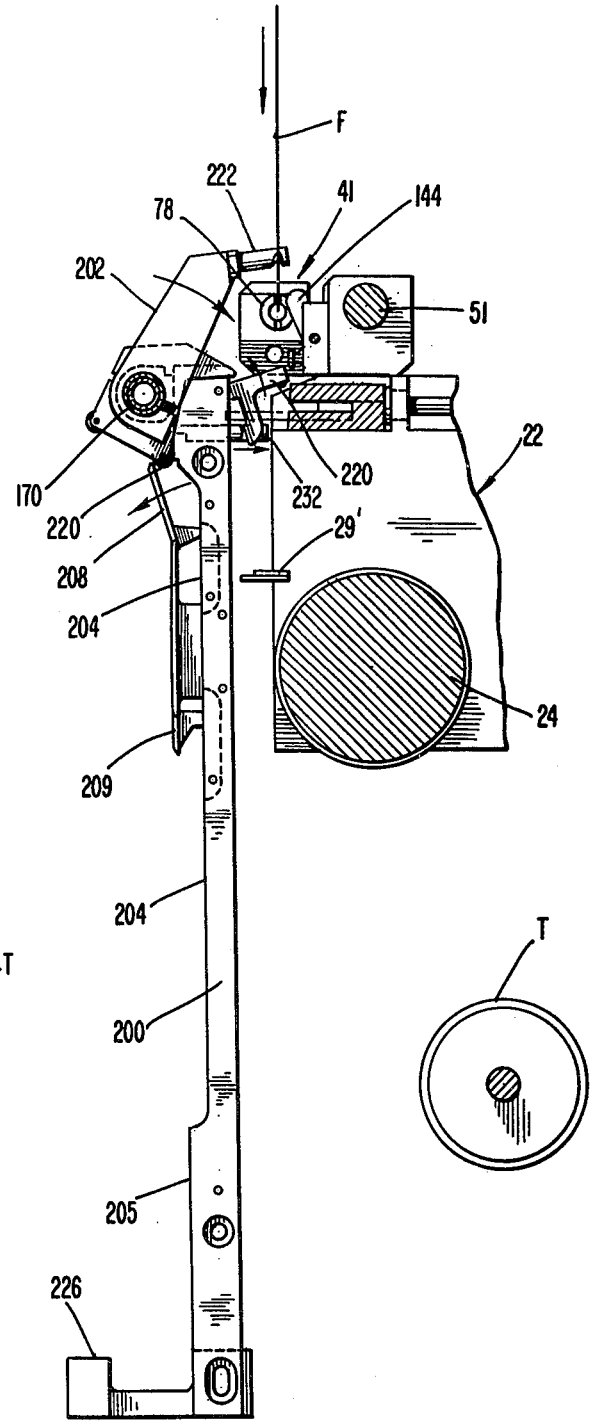
FIG. 5 is a view similar to FIG. 4 after the cutter head has extended and cut both yarns and the transfer arms in the process of being swung forwardly to a position in which they will intercept the yarns when the cutter head is retracted.

As the yarn winding operation proceeds, the carriage 174 is continuously urged toward its uppermost limit (FIG. 17) on the post 184, but is restrained from that limit (i.e., remains "parked" in FIG. 16) by means of a releasable stop latch 230. The stop latch comprises a horizontal bolt 232 which slides horizontally in an aperture 234 of the cam bar and is biased by a spring 236 to a position (FIG. 16) in the travel path of the stop element 182 carried by the carriage 174. The bolt is releasable by means of a lever 240 which is pivoted to the cam bar 200 about a horizontal axis 242 and which includes a leg 244 extending into a recess of the bolt 232. A contact leg 246 of the lever extends into the vertical travel path of a cam face 248 of the winder head 22 such that as the winder head 22 is raised (during a yarn package doffing sequence), the bolt 232 is slid open (FIG. 18) to enable the carriage 174 to complete its ascent, with ensuing rotation of the guide arms 46, 46' as the cam follower wheel 220 rides along an inclined cam surface 250 toward the upper surface 203 (FIG. 5). This upward travel of the follower wheel 220 is permitted by the ability of the upper ramp 208 to be swung out of the way in response to being contacted by the wheel (FIG. 5). The latch 230 is disposed sufficiently above the winder head 22 to assure that release of the latch by the winder head occurs only after the gathering head 41 has been extended and severed and aspirated both yarns F, F' (FIG. 2). Return of the gathering head 41 to its retracted position cannot occur until the carriage reaches its uppermost position (i.e., until the carriage activates an upper limit switch 252 (FIG. 2). In this fashion, the carriage completes its ascent and the ends 222, 222' of the guide arms 46, 46' are rotated forwardly into the yarn plane before the gathering head 41 retracts.

With the gathering head 41 extended, and with the guide arms 46, 46' in their forward positions (FIGS. 17, 21, 22), the free end 222 of the first guide arm 46 is situated inwardly of the first yarn F (i.e., to the left of the first yarn F as seen in FIG. 22), and the free end of the second guide arm 46' is situated between the yarns F, F' (FIG. 22). When the gathering head 41 is thereafter retracted, the second yarn F' enters a groove 260' formed in the outer end of the second guide arm 46', and the first arm enters a groove 260 formed in the outer end of the first guide arm 46. The yarns thus pass along those grooves 260, 260' on their way to waste via the aspirator, as depicted in FIG. 14.

The descent sequence of the guide arms 46, 46' (i.e., a threading procedure) begins with the application of a subsequent signal, either manually from an operator or automatically from an automated system. In response to such signal, the winder head 22 descends toward the package spindle 16 and the cable cylinder 186 lowers the carriage 174. Accordingly, the cam follower wheel 220 travels along the topmost straight cam surface 203 and the upper ramp 208 (FIG. 6), while the free ends of the guide arms 46, 46' pull the yarns F, F' downwardly. When the follower wheel 220 reaches the lower ramp 209, the latter swings forwardly, enabling the follower wheel to switch onto the intermediate surface 204 (see broken line position of FIG. 7). As this occurs, the shaft 170 rotates under the influence of the spring 176 to move the free ends of the guide arms 46, 46' and the yarns F, F' rearwardly out of the plane of the deflector arm 167.

Thereafter, the guide arms 46, 46' travel downwardly and displace the yarns F, F' past the tailing guides 29, 29'. At this point, the cam follower wheel rides along a second inclined cam surface 262 (FIG. 7) and moves the free ends of the guide arms 46, 46' forwardly to a position beneath the tailing guides 29, 29' (FIG. 7) to thread the yarns into the respective tailing guides 29, 29'. Each yarn now travels downwardly from a spinneret, through the associated tail guide, around the groove 260 in the associated guide arm 46 or 46', upwardly across the deflecting arm 167, and into the aspirator 70.

As the carriage 174 further descends, the cam follower wheel 220 contacts the cam projection 226 (FIG. 8) and causes the free ends of the guide arms 46, 46' to be swung toward the winder to a position just below and beyond the standard throw-on guides 32, 32'. The yarns F, F' are thus threaded into those guides 32, 32'.

At this point, the carriage 174 engages a lower limit switch 270 (FIG. 2) to actuate a timer which, after counting-down a period sufficient to enable the empty tubes T to reach full speed (the latter having by now been engaged and driven by the drive head 22), signals the conventional control mechanism for the throw-on guides 32, 32'. The guides 32, 32' are then swung to carry the yarns under the tubes and into standard pinch grooves in the empty tubes T (FIG. 8). When the yarns become tensioned between the aspirator and the pinch grooves, they break. Accordingly, the newly formed lead ends of the yarns are wound upon the tubes and the carriage 174 re-ascends.

It will be appreciated that in lieu of transferring the yarns to throw-on guides 32, the present invention could be designed to insert the yarns directly into the tube pinch grooves.

The cam follower includes an extension leg 272 which extends over an abutment 274 on the drive head 22 of the winder. This leg 272 assures that the carriage 174 cannot descend at too fast a rate relative to the drive head 22. That is, engagement between the extension leg and the winder head 22 will occur to prevent the former from threading the new yarns onto the empty tubes before the winder head has been able to accelerate the empty tubes up to a certain minimum speed.

Tail-Making Mechanism

As noted earlier, as the new yarns are being drawn downwardly by the guide arms 46, 46' they are inserted into the tailing guides 29, 29'. Since the tailing guides are of identical construction, only one will be described hereinafter in detail. The tailing guide 29 (FIGS. 40–44) comprises a multi-part assembly which includes a pair of superimpsoed stationary cam plates 276 and a retainer plate 277 which is reciprocably movable between the stationary cam plates 276. The cam plates 276 are affixed to a stationary tube 276A which is mounted on the drive head 22. The retainer plate has a horizontal slot 278 formed therein which is open in a direction facing away from the drive head 22 and is of sufficient width to receive a yarn F when in position 277A (see FIG. 43). The retainer plate 277 is movable relative to the stationary plates 276 such that the slot 278 can be moved to a position 277B beneath horizontal front edges 279 of the cam plates (FIG. 43). Those front edges 279 are inclined in a direction having components away from the slot 278 and away from the drive head 22. Thus, when the slot 278 passes between the front edges 279 while carrying a yarn F, the front edges 279 will cam the yarn out of the slot 278.

Movement of the receiving plate 278 is effected by an air-driven actuating piston 280 which is mounted in a chamber 281 of a block 282 (FIG. 40). The actuating piston 280 is connected to an actuating rod 280A which reciprocates within the stationary tube 276A. The rod 280A is connected to the retainer plate 277 by an arm 280B and is spring-biased, preferably by a coil compression actuating spring 280C to a retracted position (i.e., to the right in FIG. 40) wherein the slot 278 is spaced laterally from the cam plates 276 (phantom lines in FIG. 43). The admission of pressured air via a passage 282, into the chamber 281, behind the actuating piston 280 causes the latter to extend (FIG. 41) and push the slot 278 beneath the cam plates 276.

The tailing guide mechanism described thus far is basically conventional. In practice, yarn F is inserted into the slot when the associated guide arm 46 is swung inwardly in response to engagement between the follower wheel 220 and the cam surface 262 (FIG. 7). It will be appreciated that while the yarn F is disposed within the slot 278, it cannot be captured by the traverse guide 28 and thus a selected amount of yarn will be wound at one end of the tube to form a waste bunch prior to the commencement of the yarn package build. The waste bunch assures that only standard quality yarn is wound onto the package. A "transfer tail" is then formed by the release of yarn F from slot 278 and captured by traverse guide 28. The "transfer tail" yarn is of the same quality as the package yarn because the accumulation of the waste bunch eliminates yarn which may have experienced a tension change. The "transfer tail" enables the subsequent user of the yarn package to tie a plurality of packages together to thereby form a continuous threadline for subsequent uninterrupted yarn processing such as in knitting, weaving, creeling, etc. The "transfer tail" is formed by the movement of piston 280, guide 280B and guide tip 277A along stationary cam surface 279 to position 277B as further described hereinafter.

In accordance with the present invention, there is provided a gate 283 (FIG. 43) on a side of the slot opposite the cam plates 276. The gate includes a projection 284 which is adapted to overlie a yarn disposed in the slot 278 when such slot is moved to a position (solid lines in FIG. 43) from its normal yarn-receiving position. Such movement is effected by providing a movable stop pin 285 behind the actuating piston 280 (FIG. 40). The stop pin 285 extends through a block 286, the latter being attached to an air-driven regulating piston 287. The piston 287 is movable parallel to the actuating piston 280 in a chamber 288 which communicates with pressurized air via an inlet 289. A coil compression spring 290 biases the regulating piston 287 and its stop pin 285 to a stop position (depicted in FIG. 41) which prevents the slot 278 from being moved beneath the gate 283 by the action of the actuating spring 282. However, under the urging of air pressure from inlet 289, the regulating piston 287 and the stop pin 285 are displaced (to the right as viewed in FIG. 40) to enable the actuating spring to displace the actuating piston 280 and thereby shift the retainer plate 277 and slot 278 toward the gate 283. Hence, the yarn F which is seated in the slot 278 will be prevented from escaping therefrom.

This blocking of the slot 278 is timed to occur prior to the threading of the yarn F into an empty tube T. When such threading does occur, the yarn will be inescapably contained within the slot 278. As the tube T rotates the yarn upwardly, the initial slackening of the yarn is not able to flip the yarn from the slot 278, due to the blockage of the yarn by the gate 283.

After a prescribed winding interval has taken place, the normal actuation of the retainer plate 277 occurs whereby the latter is shifted to position 277B in FIG. 43, so that the front edges of the cam plates 279 eject the yarn from the slot 278. Thereafter, a normal oscillation of the yarn parallel to the package takes place.

Control Circuitry

In accordance with the present invention, the winder is actuable by conventional manual push-button controls and/or automatically as by computer-generated signals, for example. In FIGS. 45A, 45B there is depicted an overall circuitry for actuating the winder and yarn handling mechanism. Since the circuitry for the winder mechanism is conventional, emphasis will be placed in this discussion on the circuitry for operating the yarn handling mechanism.

Heretofore, when it has become necessary to doff a conventional winder, the yarns were manually cut and a stop button 300 was manually depressed which caused the winder head cylinders 302 to raise the winder drive head 22, and the brake 304 to stop the spindle 16.

In accordance with the present invention, however, an automatically operated, remotely controllable electric solenoid 306 (FIG. 45B) is arranged in fluid circuitry with the manual stop button 300 such that a signal from either source will commence a doffing/donning sequence. The signal to the solenoid 306 may originate, as noted earlier, from a computer which monitors the winder, e.g., by monitoring the time period in which winding has occurred. If desired, however, the doffing/donning sequence could be commenced by manual depression of the stop button 300.

When either the stop button 300 or the stop solenoid 306 is actuated, fluid is admitted through a conventional "or" gate 308 and circulated through a conduit 305 to shift a valve 307, the latter serving to conduct fluid via conduit 307A to the aspirator 58 and to the air piston 148 to open the flapper plate 144 at the front of the gathering head 41. Fluid from the conduit 305 also communicates with a flip-flop 310 (FIG. 45B) which delivers fluid to a conduit 312 which activates the initial air piston 160 of the trailing end control mechanism 153 to extend the first arm 156. In so doing, the initial yarn Y is pushed from its traverse guide 28 and captured by the notch 162 (left-hand side of FIG. 24). The yarn is thereafter wound in close order on the package.

At the same time, a first timer 314 is actuated which after a pre-set interval, admits fluid to a conduit 316 to shift a valve 318. As a result, pressurized fluid is directed via conduit 318A to the piston end of the fluid cylinder 50 to extend the gathering head 41. As the switch 110 (FIG. 26) encounters the first set of cams 128, the cutter blade 82 is reciprocated to sever the yarn F so that the oncoming yarn is aspirated to waste.

Fluid supplied via the conduit 316 to actuate the valve 318 passes through a switch 320 which is held open by the carriage 174 while the latter is in its rest position (FIGS. 2, 4).

The fluid from the first timer 314 actuates a second timer 322 which, after a pre-set period, directs fluid via passage 322A to the other air piston 160' to extend the other arm 156' of the trailing end control mechanism 153 (right-hand side of FIG. 24). There occurs a predetermined interval before the cutter 82 severs the second yarn F' in order to enable a sufficient amount of the second yarn to be wound in close order on its package.

When the gathering head 41 reaches the end of its stroke (i.e., after both. yarns F, F' have been severed and aspirated—FIGS. 21–22), the limit switch 140 (FIGS. 21, 45B) is actuated to direct fluid to conduit 326 for initiating the raising of the winder drive head 22 and actuate the brake 304 for the spindle 16. When the winder head 22 reaches its uppermost position, it displaces the latch 220 (FIG. 18), enabling the upwardly-biased carriage 174 to further ascend to its uppermost position (FIG. 17), whereupon the transfer arms 46, 46' are swung toward the plane of the yarns F, F' (FIG. 17), and whereby the limit switch 252 (FIG. 2) is tripped. In so doing, the valve 318 (FIG. 45B) is shifted so as to direct fluid to the rod side of the ram 50 and cause retraction of the gathering head 41.

When the gathering head 41 has been fully retracted, the switch 142 (FIG. 25) is tripped so as to direct fluid to an "and" gate 332 (FIG. 45A) via a conduit 334. Fluid has already been directed to the "and" gate 332 as a result of actuation of a "start" solenoid 336 (FIG. 45B) by the computer. In the absence of a computer control, the "and" gate can be energized by a manual push-button 338 (FIG. 45A). Fluid is thus directed through a flip-flop 340 (FIG. 45A) to the conventional motor 341 for the throw-on arms 30 to extend same to the sold line position of FIG. 8. Simultaneously, the fluid is directed via conduit 342 (FIGS. 45A,B) to shift a valve 344 (FIG. 45B) in order to cause the cylinder 186 to lower the carriage 174 and transfer arms 46, 46'.

The energizing of a computer-controlled push-out solenoid 346 (or a manual push-button 348) causes a conventional push-out cylinder 350 of the winder to push the filled packages 18, 18' from the spindle 16.

When the carriage 174 reaches its lower position (FIG. 8), the limit switch 270 (FIGS. 2, 45B) is tripped, whereby fluid is directed via a conduit 354 to the piston 288 of the tail-making guides 29, 29' (FIG. 40) to displace the latter and cause the yarns F, F' to be secured by the gates 283. simultaneously, fluid from the conduit 354 activates a third timer 356 (FIG. 45A). After a pre-set interval, this third timer 356 directs fluid to the winder head cylinders 302 to lower the winder drive head 22. At the same time, fluid is directed to the throw-on motor 340 via conduits 360, 362. The throw-on arms 30, 30' are thus retracted to insert the yarns F, F' into the pinch grooves of empty tubes which have been installed on the spindle 16.

Fluid from the third timer 356 is also directed, via conduits 360, 364 to the actuating piston 280 of the tail-making guides 29, 29' to shift the receiver plates 277 and release the yarns F, F'.

A fourth timer 366 (FIG. 45A) is activated by fluid from the third timer 356. After a pre-set interval, the fourth timer 366 directs fluid to the carriage-control valve 344 via a conduit 368 to raise the carriage 174 and control arms 46, 46'. Simultaneously, the valve 307 is urged closed to cut-off the flow of fluid to the aspirator, whereupon the closure flap 144 closes over the suction inlet 70.

Operation

To facilitate a complete understanding of the invention, the entire operational sequence of the aforedescribed yarn handling system will now be summarized.

A yarn winding operation proceeds in the usual fashion, with the drive head 22 rotating the yarn packages and gradually rising as the packages become filled. The yarns F, F' travel downwardly through the traverse guides 28, 28' and through the helical slots 26, 26' in the grooved roll 24, and onto the packages 18, 18'.

The yarn gathering head 41 waits in a parked or rest mode (FIGS. 1 and 10), with the carriage 174 being urged upwardly by the cable cylinder 186 against the stop latch 232 (FIG. 16). In this position, the free ends of the guide arms 46, 46' are located outwardly from the common vertical plane of the yarns F, F'.

When the winding operation is completed, a signal is furnished to the machine. This signal may be produced by an operator manually pushing a "stop" button 300 on the winder (FIG. 3), or by means of a signal from a computer if the winder is part of an automated system. In response to that signal, pressurized fluid is supplied to the pneumatic piston 160 (FIG. 24) to extend the initial control plate 156. In this fashion, the initial yarn F is pushed out of its traverse guide 28 and is captured within the notch 162 of that control plate 156. At this point, the yarn is wound in relatively tight, close order upon the package 18. At a prescribed interval after extension of the initial control plate 156, pressurized fluid is supplied to the pneumatic cylinder 50 which extends the reciprocable mechanism 47, including the gathering head 41, toward the yarn F. Eventually, the first or inner yarn F enters the slot 90 of the stationary blade 84 and becomes trapped within the lateral position 96 of that slot (FIGS. 28, 34). The yarn F is thus received within the vertical slit 80 in the aspirator tip 78 and is pressed tightly therein as the yarn F continues to be wound in close order upon the package 18.

Within this time frame, pneumatic fluid is delivered to the piston 148 (FIGS. 38–39) to swing open the flapper plate 144 and thereby unblock the opening 70 to the inlet passage 69. Also, pneumatic fluid is delivered to the nozzle ring 64 (FIG. 27) to induce a working suction in the inlet passage 69.

As the gathering head 41 approaches the initial yarn F, the initial set of cams 128 actuates the follower arm 105 of the poppet valve 110 (FIG. 26), and pressurized fluid is supplied to the working compartment of the chamber 104 in the cutter sleeve 76 (FIG. 29). When pressure in that compartment 104 builds-up sufficiently to overcome the restraint imposed by the detent 122, the reciprocable blade 82 snaps outwardly across the lateral portion 96 of the slot 90, thereby severing the yarn F which is immediately sucked into the inlet tube 69.

As the gathering head 41 advances, the second conduit plate 156' is extended to eject the second yarn F' from its traverse guide 28 and capture such yarn within its notch 162' (FIG. 24). Thus, the yarn F' is wound in tight order upon the second package 18'. Eventually, the second yarn is also cut and aspirated to waste by the gathering head 41. Thus, both yarns F, F' now travel through the inlet passage 69 and are aspirated to waste. At the end of the forward stroke of the gathering head 41, the drive head 22 is raised, thereby breaking-off the drive relationship with the packages 18, 18' (FIG. 4).

Simultaneously, the brake 304 (FIG. 45A) is actuated to stop rotation of the packages.

Thereafter, the ascending drive head 22 engages the latch disengagement lever 246 and retracts the stop bolt 232 (FIG. 18). This enables the carriage 174 to complete its upward movement by swinging the upper ramp 208 away from the cam bar 200 (FIG. 5), whereupon the cam follower wheel 220 engages the first cam surface 203 and swings the guide arms 46, 46' toward the winder (FIG. 17). Accordingly, the free ends of the guide arms become disposed within the yarn plane inside of the respective yarns (i.e., between the frame 14 and the respective yarn). When the carriage 174 reaches its uppermost position, retraction of the gathering head 41 is initiated. Accordingly, the hydraulic cylinder 50 retracts and the gathering head 41 returns to its original retracted position. During such retraction, the yarns F, F' respectively engage the grooves 260, 260' of the guide arms 46, 46'. At the end of the retraction stroke (i) the throw-on guides 32 (FIG. 8) are extended, (ii) the carriage 174 begins to descend, and (iii) the push-out cylinder 350 is actuated to push out the filled packages. These packages are removed and replaced by empty tubes T. As the carriage 174 descends, it swings the lower ramp toward the cam bar 200 (FIG. 7), thereby rotating the ends of the transfer arms 46, 46' rearwardly (i.e., counterclockwise in FIG. 7).

The carriage 174 continues its descent until the cam follower wheel 208 engages the lowermost cam surface 205, thereby causing the guide arms 46, 46' to swing toward the winder so that the free ends of the guide arms are located below the tailing guides 29, 29' to thread the yarns F, F' into the slots 278 of those tailing guides (FIGS. 7 and 43). Further descent of the carriage 174 brings the second cam follower wheel 214 into engagement with the cam projection 226 which produces further rotation of the free ends of the guide arms 46, 46' toward the winder 12 at a location below the standard rethreading guides of the winder (FIG. 8). As a result, the yarns F, F' are positioned to become picked-up by the standard throw-on guides 32, 32', when the latter are swung toward the empty tubes T, T'. When the carriage 174 has fully descended, the limit switch 270 is activated, thereby starting a timer which controls the moment at which the throw-on guides 32 are swung toward the empty tubes. This time period is required in order to assure that the drive head 22 has sufficient opportunity to bring the empty tubes up to final speed. The actual rethreading of the yarns occurs in a conventional manner as the throw-on guides insert the yarns F, F'into the usual pinch slots in the empty tubes. Accordingly, the yarns are captured by the rapidly rotating tubes, thus producing tension in the yarns between the tubes and the aspirator of such a degree that the yarns are broken.

The arrival of the carriage 174 at the bottom of its stroke also causes pneumatic fluid to be delivered to the regulating piston 287 and shift same in a direction (FIG. 40) which enables the spring 280C to displace the rod 280A, and thus the retainer plates 277, to a position in which the gates 283 block the yarns F, F' against egress from the slots 278 (see the solid line position of the plate 277 in FIG. 43). Accordingly, the yarns F, F' cannot escape from the slots 278 when the yarns are rotated by the empty tubes. After a preset interval, the regulating piston 287 returns to its normal position (FIG. 41), thereby pushing the rod 280A, and thus the retaining plates 277, to a position (leftmost broken line position in FIG. 43) so that the yarns are expelled from the slots 278 and become caught by the traversing guides 28, 28'.

With the rethreading operation completed, the carriage 174 ascends into engagement with the latch 220 and the fluid ram 146 swings the housing 52 about the vertical pivot pin 54, thereby returning the gathering head 41 to its normal rest position.

It will be appreciated that the present invention enables the trailing end of a wound yarn to be wound in close-order upon a package without imposing tension spikes on the yarn. The control plate ejects the yarn from the traverse guide so that the yarn does not travel through severe tension-inducing angles and also does not become dislodged from the notch. The control plate is arranged in a compact, unobtrusive manner upon the winder and thus creates little if any interference with standard activities and operations.

Although the present invention has been described in connection with a preferred embodiment thereof, it will be appreciated by those skilled in the art that additions, substitutions, deletions, and modifications may be made without departing from the spirit and scope of the invention as defined in the appended claims.

What is claimed is:

1. A winder for winding packages of filamentary material, comprising:

means for rotating a package about a longitudinal axis to wind-up filamentary material which is fed thereto, traversing means for traversing the filamentary material along the package axis to produce a helical winding of the filamentary material, and controlling means for engaging the filamentary material prior to the completion of a winding sequence to cause the trailing end of the filamentary material to be wound for a plurality of turns in non-helical, close-order relationship on the package to resist subsequent unraveling of the filamentary material, said controlling means comprising a movable arm including a contact edge oriented generally parallel to a plane defined by the traversing movement of the filamentary material, said arm being mounted for movement toward and away from such plane to contact the filamentary material and displace same out of said traversing means, said contact edge including a stop for constraining the filamentary material for winding in a non-helical, close-order relationship onto the package.

2. A winder according to claim 1, wherein said movable arm contacts the filamentary material upstream of said traversing means.

3. A winder according to claim 1 including a grooved roll disposed downstream of said traversing means, said grooved roll including an annular groove aligned with said stop to guide the filamentary material for close-order winding upon the package.

4. A winder according to claim 1, wherein said stop comprises a notch in said contact edge.

5. A winder according to claim 1 including a cutter-aspirator for cutting the filamentary material and aspirating same to waste, and means for actuating said cutter/aspirator a preset interval after said movable arm has been extended to displace and constrain the filamentary material.

6. A winder according to claim 5 including an additional arm for displacing and constraining additional filamentary material, and means for moving both of said arms at identical preset intervals prior to the filamentary material being severed by said cutter/aspirator.

7. A winder according to claim 1 including a drive head which is movable toward and away from the package, said drive head including a drive roll which drivingly bears against the package, said controlling means being mounted on said drive head.

8. A winder according to claim 1 including a fluid pressure-fluid piston connected to said movable arm for moving same.

9. A winder according to claim 7, wherein said drive head moves upwardly and downwardly, said movable arm comprising a horizontal plate mounted adjacent the top of said drive head.

10. A winder for winding packages of filamentary material comprising:

means for rotating a package about a longitudinal axis to wind-up filamentary material being fed thereto, a drive head movable toward and away from the package and including:

a drive roll for bearing against the package to rotate same, a reciprocable traversing guide for oscillating the filamentary material generally parallel to said axis to produce a helical winding of the filamentary material, a grooved roll disposed downstream of said traversing guide and including a helical groove for conducting the oscillating filamentary material onto the package, and a non-helical circumferential groove, and a movable arm including a contact edge oriented generally parallel to a plane defined by oscillation of the filamentary material, said movable arm being mounted for horizontal movement toward and away from such plane to contact the filamentary material upstream of said traversing guide and displace the filamentary material out of said traversing guide, said contact edge including a notch aligned with said non-helical circumferential groove of said grooved roll to engage and constrain the filamentary material so that the filamentary material is wound in a non-helical close-order pattern onto the package.

11. A winder according to claim 10, wherein said drive head moves upwardly and downwardly, said movable arm comprising a horizontally movable horizontal plate disposed adjacent an upper end of said drive head.

12. A winder for winding packages of filamentary material comprising:

a rotary spindle adapted to carry a tube, drive means for rotating said spindle to wind-up filamentary material which is delivered to the tube, said drive means comprising a drive roll mounted on a drive head which is movable upwardly away from said spindle to alternately engage and disengage said drive roll relative to said tube, a traversing guide mounted on said drive head for traversing the filamentary material along the spindle to cause the filamentary material to be helically wound upon the tube, a helically grooved roll rotatably mounted on said drive head downstream of said traverse guide, said grooved roll including a circumferential, non-helical groove, and means for displacing the filamentary material from said traversing guide prior to the completion of a winding sequence and for guiding the displaced filamentary material for non-helical winding in conjunction with said non-helical groove to cause the trailing end of the filamentary material to be closely wound upon the tube, said displacing means comprising:

a deflector arm mounted for horizontal movement on said winder head upstream of said traverse guide, said deflector arm extending parallel to said spindle and including an outer edge having a confining notch generally aligned vertically with said non-helical groove of said grooved roll, and means for displacing said deflector arm horizontally toward the filamentary material being wound such that said outer edge pushes the filamentary material away from said drive head and out of said traversing guide, said confining notch being arranged to terminate reciprocation of the filamentary material and cause same to enter said non-helical groove.

* * * * *